US006536885B2

(12) United States Patent
Kuribayashi et al.

(10) Patent No.: US 6,536,885 B2
(45) Date of Patent: Mar. 25, 2003

(54) INK-TRANSPORT SYSTEM, INK-REPLACEMENT METHOD, INK-JET PRINTING APPARATUS, AND INK-SUPPLY SYSTEM

(75) Inventors: Akira Kuribayashi, Kanagawa (JP); Tadayoshi Inamoto, Tokyo (JP); Yoshiaki Kaburagi, Kanagawa (JP); Hiroyuki Saito, Tokyo (JP); Ako Takemura, Saitama (JP); Hiroshi Yoshino, Kanagawa (JP); Mariko Suzuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 12 days.

(21) Appl. No.: 09/774,695

(22) Filed: Feb. 1, 2001

(65) Prior Publication Data

US 2001/0020970 A1 Sep. 13, 2001

(30) Foreign Application Priority Data

Feb. 3, 2000 (JP) ..... 2000-026110
Feb. 3, 2000 (JP) ..... 2000-026111
Feb. 3, 2000 (JP) ..... 2000-026116

(51) Int. Cl.[7] ..... B41J 2/175

(52) U.S. Cl. ..... 347/85

(58) Field of Search ..... 347/84, 85, 86, 347/87, 30, 65, 92

(56) References Cited

U.S. PATENT DOCUMENTS 4,558,326 A * 12/1985 Kimura et al. ..... 347/30
5,278,585 A * 1/1994 Karz et al. ..... 347/65
5,751,301 A 5/1998 Saikawa et al. ..... 347/8
5,825,387 A * 10/1998 Cowger et al. ..... 347/86
5,946,014 A 8/1999 Shimomura et al. ..... 347/87
6,059,405 A * 5/2000 Mochizuki et al. ..... 347/92

FOREIGN PATENT DOCUMENTS

JP 5124189 * 5/1993 ..... B41J/2/05
JP 11-254700 9/1999

* cited by examiner

*Primary Examiner*—Anh T. N. Vo
(74) *Attorney, Agent, or Firm*—Fitzpatrick, Cella, Harper & Scinto

(57) ABSTRACT

The present invention facilitates a supply of ink with a structural components at relatively low costs. It is performed by shifting a printing head having ink ejecting portion and sub tank portion into a state of reduced pressure. That is, draining ink from the sub tank portion to the outside and supplying ink from an ink storage container to the sub ink portion are performed by a reduced pressure in the printing head. Also, a carriage on which the printing head can be mounted shifts its position, and a plurality of ink receiving portions communicated with a plurality of their relative sub ink tank and a plurality of ink supplying portions communicated with a plurality of their relative main ink tanks are arranged in a predetermined manner. That is, the plurality of sub ink tanks and a plurality of main ink tanks are communicated together on a pair basis.

24 Claims, 25 Drawing Sheets

| FIG.23A | FIG.23B |
| --- | --- |

INK-TRANSPORT SYSTEM, INK-REPLACEMENT METHOD, INK-JET PRINTING APPARATUS, AND INK-SUPPLY SYSTEM

This application is based on Patent Application Nos. 2000-26110, 2000-26111 and 2000-26116 filed Feb. 3, 2000 in Japan, the content of which is incorporated hereinto by reference.

BACKGROUND OF THE INVENTION

1. Field of the Invention

The present invention relates to an ink-transport system to be used in an ink-jet printing apparatus, an ink-replacement method, an ink-supply system, and an ink-jet printing apparatus. Especially, the present invention relates to a technology suitable for frequently changing various kinds of inks depending on the type of printing media, printing characteristics of the printing apparatus, and so on.

2. Description of the Prior Art

The ink-jet printing system is carried out by causing fine droplets of inks to fly and adhere to a printing medium such as paper based on various operational principles, to print images, characters, or the like, thereby enabling printing with low noise at a high speed. The ink-jet printing system has advantages such as facilitation of multicolor printing and is characterized by a high degree of freedom for recordable patterns, elimination of the necessity of development or fixation, and others. Thus, printing apparatuses based on this system method have been rapidly spread in various fields including that of data processing to accommodate various images and print media.

In addition, images formed by means of the multicolor ink-jet printing system can easily stand comparison with multicolor printing based on the plate making system or photographic printing based on the color photographing system. The multicolor ink-jet printing system enables images to be produced more inexpensively than normal multicolor printing or photographic printing if a small number of copies are particularly to be printed and is thus widely used in the field of full-color image printing. There are two types of the conventional ink-jet printing apparatuses. One is that an ink tank portion and an printing head portion are integrally formed together so that they cannot be removed from each other. The other is that an ink tank portion and a printing head portion are integrally are independently formed so that they can be removed from each other. In the former (i.e., the integral type printing apparatuses), they can be further grouped into additional types to cope with a shortage of ink. That is, one is that both the ink tank and the printing head are replaced with the new ones, respectively; and the other is that a shortage of ink is compensated by refilling the ink tank with ink from the outside. In the latter (i.e., the printing apparatus with the ink tank to be detached from the printing head), the ink tank can be replaced with the new one filled with ink when the ink tank becomes almost empty.

For the both cases, however, the ink tank is refilled with the same type of ink as one used before in the printing apparatus.

To accommodate wider applications of the ink-jet printing system and enable the recent improvement of printing characteristics such as an increased printing speed, an improved definition, and full color printing, efforts are being made to improve the printing apparatus and method. Characteristics required to achieve wider applications of the ink-jet printing system and improve the printing characteristics include, for example, a high density of printed ink dots, bright and clear color tones, fast ink absorption, prevention of outflow or bleeding of inks despite overlapping ink dots, and spread of ink dots with appropriate bleeding.

It is known that these characteristics are realized not only by the printing apparatus and method but also by improving inks or printing media used for printing.

For example, it is known that a coated paper is used as a printing medium due to ink absorptivity and fixability achieved thereby. The coated paper comprises, for example, a silicon pigment such as silica, or an absorbing polymer including a resin such as colloidal silica, polyvinyl pyrrolidone, polyvinyl alcohol, polyethylene oxide-isocyanate crosslinked material, or an acrylic polymer having a carboxyl group, or an aluminum-based pigment such as alumina hydrated compound or aluminum oxide, which is each coated on a paper, a film, a cloth, or the like together with an aqueous binder or the like. On the other hand, inks have their permeability adjusted by means of a surface-active agent or the like contained therein.

To accommodate the improvement of the printing characteristics, however, an optimal combination of printing media and inks which can realize these characteristics is more preferably selected by individually selecting printing media or inks depending on each of the characteristics. This is because the inks and the printing media show each of the characteristics through their mutual relationship.

In this case, to specifically realize the optical combination of the printing media and the inks in an ink-jet printing apparatus, configurations and operations are required which replace or install the printing media or the inks depending on a combination of printing media and inks. Additionally, an operation is required for setting printing conditions on, for example, a host computer; for example, a printing mode must be set depending on such a combination. That is, it is cumbersome to carry out the above operations or setting operations each time the combination is switched. It is also difficult for a user to obtain the optimal combination.

In this respect, an official gazette of Japanese Patent Application Laying-open No. 11-254700 (1999) discloses a media cartridge to be removably mounted on a printing apparatus. The media cartridge has a single-piece construction provided as a combination of: a cassette member on which sheets of printing media are mounted; and an ink tank or a waste ink tank for holding waste ink. The printing apparatus recognizes the presence of the media cartridge removably mounted thereon and automatically defines its printing mode with reference to the types of the printing medium and the ink. Therefore, it allows an appropriate printing control that depends on the above combination of the printing medium and the ink.

The printing apparatus using the media cartridge such as one disclosed in Japanese Patent Application Laying-open No. 11-254700 (1999) is suitable for forming an image of high quality on a sheet of high-priced printing medium. In other words, the configuration of the printing apparatus avoids a mismatched combination of printing medium and ink, so that an image formation can be performed simply and easily without making any mistakes. Therefore, the above printing apparatus has been valued as being extremely useful for forming various kinds of images in low volume.

In the above printing apparatus, however, ink has been frequently changed from one kind to another in accordance with the replacement of the media cartridge with the new one. In this case, there is a necessity that ink in the printing head is also changed from one kind to another, so that the printing apparatus can be expensive as a whole if the printing heads are prepared to correspond with various kinds of inks.

For replacing the media cartridge with the new one, there is a need to drain ink out of both the ink tank and the head and to refill them with ink from a new media pack to be replaced. In this case, an insufficient drain of ink may be caused if the ink is drained from ink ejection ports of the head by applying pressure to the inside of the ink tank. If the ink to be supplied by the media cartridge after the replacement has a color different from that of the prior cartridge, ink to be ejected from the printing head may be of a color mixture with the prior ink. It causes a problem that the printing head ejects ink having a color different from the desired one.

If the printing head and the ink tank are filled with acid ink even though they had been filled with ink of an alkali-soluble dye, it facilitates coagulation or precipitation of the dye out of the ink. If so-called pigment ink prepared by dispersing pigment particles into a coloring material is replaced with another type of the pigment ink, the dispersing state becomes worse by the differences in their properties such as pH values, concentrations, and solvent compositions and such a state facilitates coagulation of pigment particles. As a result of causing precipitates or agglomerates in the ink, such undesired materials may block ink ejection ports of the printing head or adhere to a face surface (i.e., a surface of the printing head on which the ink ejection ports are formed). Consequently, any deleterious effect can be produced on the ability to eject ink droplets from each ink ejection port with stability. Furthermore, if the ink ejection ports tend to be closed as the printing head has not been used for a long time, there is a necessity to drain ink from both the ink tank and the head.

In summary, therefore, the conventional ink-supplying system for an ink-jet printing apparatus has the problems in which:

- a high quality image cannot be obtained because of using ink manufactured specifically for ordinary paper and held in the media cartridge;
- the price of the printing apparatus as a whole is considerably increased because of using a printing head designed specifically for each of different ink variations or using a disposable head; and
- different ink colors may be mixed after replacing ink in both the ink tank and the head with ink of different color.

In the conventional printing apparatus for making a high quality image, there may be cases where various kinds of inks are used in addition to basic inks of three primary colors. The inks may include special inks, for example light-colored ink having a low concentration and dark-colored ink having a high concentration. If the various kinds of inks are used, variations in the amount of each ink consumed can be easily occurred. In this case, there may be the need for the supply of only one kind of ink. In this case, by the way, there is a limit to the amount of ink in an ink-reserving chamber as an ink supply source equipped in the ink media pack mentioned above can store. In addition, an ink tank mounted on a carriage of the printing apparatus is replenished with only a small amount of ink. Therefore, the number of occurrences in requesting the supply of such specific ink will be increased.

In the conventional ink-introducing system, however, each of the ink tanks mounted on a carriage cannot be replenished with ink, independently. The user is forced to replenish all of the ink tanks with ink at the same time. Therefore, user does not introduce ink to only specific ink tank.

More specifically, the conventional ink-jet printing apparatus comprises a plurality of ink-storage portions in an ink tank, where ink-introducing openings are respectively formed on the top faces of ink-storage portion and arranged in a line. In addition, a plurality of ink-introducing needles to be removably inserted into the respective ink-introducing openings is arranged in a line parallel to the line of openings. For replenishing the ink-storage portions with ink, each ink-introducing needle is inserted into the corresponding ink-introducing opening. Then, the ink-introducing needles concurrently replenish their respective ink-introducing openings with ink. Therefore, the ink-storage portion with a sufficient amount of ink remained forcefully receives the supply of ink, so that the amount of ink to be supplied from each ink-introducing needle should be adjusted to the ink consumption amount of ink consumed minimum amount. As a result, there are very serious problems that a sufficient amount of ink cannot be supplied to the target ink-storage portion and the supply of ink should be repeated at very close intervals.

As described above, in Japanese Patent Application Laying-open No.11-254700 (1999) mentioned above describes the media cartridge provided as a combination of the cassette holding printing medium and the ink tank. However, it does not specify the configuration of the printing apparatus with consideration given to make the printing apparatus as compact as possible and to facilitate handling of the cartridge, and also given to a particular use thereof.

Furthermore, the above document does not teach any combination of printing medium and ink that achieves the desired printing properties of the printing apparatus with consideration given to raw materials and compositions of both the printing medium and the ink. In the above document, if plural sheets of ordinary paper is set as the printing medium in the cartridge, a treatment liquid that makes a dye in ink insoluble, black, yellow, magenta, and cyan ink are set as ink in the ink tank. In the above document, however, if plural sheets of coated or glossy paper or overhead transparency films (OHP sheets) as the printing media in the cartridge, black, yellow, magenta, and cyan ink can be set as ink in the ink tank with the exception of the treatment liquid. The reason is considering the fact that image quality could be declined if the treatment liquid was applied to the surface of coated paper or the like with coating of an ink-acceptable layer. For setting a mode of photographic-quality image formation, the above document describes the ink setting, for example, consisting of dark black, light black, dark yellow, light yellow, dark magenta, light magenta, dark cyan, and light cyan.

Accordingly, Japanese Patent Application Laying-open No. 11-254700 (1999) described above discloses nothing but the media cartridge designed in combination with ink to be selected from several kinds of ink which can be easily distinguished by the user in accordance with the printing medium or printing mode. On the other hand, there is an appropriate combination of printing medium and ink in terms of imparting a desired color on that medium. The appropriate ink composition varies as the row material or composition of the printing medium varies in spite of similar appearance among the medium at first glance. In this case, however, it is close to impossible that the user selects an appropriate one from the various possible combinations.

Another problem is that many ink-jet printing apparatuses presently known in the art have been designed to have their own printing properties which are more or less directed to specific requirements, respectively. Therefore, it is comparatively difficult to meet the needs for various properties described above.

One of the characteristics of the printing head as one that defines the printing properties is the longevity of the printing head in itself. If the printing head is used very often, it is required to further increase the durability of the printing head. In addition, one of the characteristics of the ink as one that defines the printing properties is to be easily removed from a nozzle by means of a so-called recovery movement or the like in spite of after being left for the comparatively long term. Furthermore, another characteristic of the ink as one that defines the printing properties is to have its own formula color, or the like which is hardly changed or tarnished. The printing properties of the conventional ink-jet printing apparatus are limited by the factors described above, such that if the manufacturer attempts to provide an ink-jet printing apparatus having all of the printing properties, there are tendencies to upsize the system and to rise the cost of manufacturing the system. Therefore, the manufacturer of ink-jet printer or the like restricts the printing properties of each type of printers so as to specifically meet at least one of user demands, such as one that makes a high quality image or one to be used at a low or high temperature. In the present circumstances, the manufacturer limits the abilities of the printers within a certain range to manufacture and sold them in the market to fill the main current of demands on printers. Therefore, if the user having an ink-jet printer with a certain printing property "A" wants to print an image using another printing property "B", there is a limit to what the printer can do even if the special mode is set up to cope with the printing property "B". For making compensation for lack of the printing property "B" to a satisfactory degree, there is a problem that the user is forced to consider purchase of an additional printer having the printing property "B".

SUMMARY OF THE INVENTION

One of the objects of the present invention is to provide a technology that offer a cheap configuration of the ink-jet printing apparatus to cope with frequent changes in the types of ink to be used without causing any trouble in the properties of ink ejection.

Another object of the present invention is to provide a technology that allows an application of an ink media pack more effectively, where both printing medium and ink are integrally housed in the ink media pack by appropriately making a combination of them.

A further object of the present invention is to provide an ink-supply system that allows that the required and enough amount of ink is independently supplied to each ink-storage portion of the ink tank.

A still further object of the present invention is to provide an ink-jet printing apparatus that realizes various printing properties thereof by its simple configuration, or more specifically to provide an ink-jet printing apparatus on which an easy-to-handle ink media pack with an integral combination of ink and printing medium or an ink tank is removably mounted to avoid a profligate use of ink and to avoid a profligate work of ink replacement.

In the first aspect of the present invention, there is provided an ink-transport system for transporting ink to a printing head capable of ejecting ink, comprising:

a first selector means for selecting one state for a passage that communicates with the printing head from a state in which the passage opens to atmosphere and a state in which the passage communicates with an ink storage container that stores ink to be supplied to the printing head; and s second selector means for selecting one state for the printing head from a state in which the printing head is under reduced pressure and a state in which the printing head communicates to atmosphere.

In a second aspect of the present invention, there is provided an ink-transport system for transporting ink to a printing head capable of ejecting ink, wherein the printing head comprises: an ink ejecting portion for ejecting ink;

a sub tank portion made of a flexible material that stores ink and communicates with the ink ejecting portion;

a first open/close mechanism for allowing a communication between the inside of the sub tank portion and the outside; and a second open/close mechanism for allowing a communication between a space portion housing the sub tank portion and the outside, and further comprises:

an atmospheric pressure introducing means which is able to introduce the atmospheric pressure into the inside of the sub tank;

an ink supply means which is able to supply ink from an ink supplying source to the inside of the sub tank;

an ink draining means which is able to drain ink from the inside of the sub tank through the ink ejecting portion; and a pressure regulating means which is able to regulate a reduced pressure in the space portion.

In a third aspect of the present invention, there is provided a method for replacing ink to be ejected from a printing head, in an ink-jet printing apparatus that performs a printing movement by discharging ink stored in an ink reserving portion through the printing head, comprising the steps of:

introducing air into the ink reserving portion;

draining ink and air from the ink reserving portion to the outside; and introducing ink into the ink reserving portion from which ink and air were drained at the draining step.

In a fourth aspect of the present invention, there is provided an ink-jet printing apparatus comprising the ink-transport system of the first or second aspect of the present invention.

In a fifth aspect of the present invention, there is provided an ink-jet printing apparatus comprising means for executing each step in the ink replacement method of the third aspect of the present invention.

In a sixth aspect of the present invention, there is provided an ink-supply system for supplying ink from a plurality of main ink tanks to their respective sub ink tanks that communicate with printing head for ejecting ink, comprising:

a plurality of ink receiving portions that are respectively communicated with the plurality of sub ink tanks, which are arranged on one of two opposite parts capable of relative movements; and a plurality of ink supplying portions to be respectively paired with the plurality of ink reserving portions, which are respectively communicated with the plurality of main ink tanks, and which are arranged on the other of two opposite parts, wherein the ink receiving portion and the ink supplying portion of each pair is able to connect together when the two opposite parts relatively move to their respective predetermined opposite positions, and the plurality of ink receiving portions and the plurality of ink supplying portions are positioned by the relative movements of the two opposite parts to their respective predetermined opposite positions that permit a predetermined number of connecting pairs at a time.

In the seventh aspect of the present invention, there is provided an ink-jet printing apparatus comprising an ink-supply system of the sixth aspect of the present invention.

In an eighth aspect of the present invention, there is provided an ink-jet printing apparatus comprising a sub ink tank capable of receiving a supply of ink from an ink tank which can be removably mounted on a body and allowing an image printing on a printing medium using ink in the sub ink tank, comprising:

an ink replacement means that allows an ink replacement movement for replacing ink in the sub ink tank with ink in the ink tank; and a control means for controlling the ink replacement means in accordance with a first ink information on the type of ink in the sub ink tank and a second ink information on the type of ink to be used in the printing movement.

According to the present invention, a same printing head and a same ink-storage portion can be always used irrespective of frequent change for the types of ink in accordance with change for the types of printing medium. Therefore, there is no need to prepare a printing head designed specifically for each type of ink and to replace the printing head with the new one every time the ink media pack is replaced with the new one. Consequently, the replacement of ink with another one can be easily and perfectly performed and also the cost to be required for the replacement of ink can be extensively decreased.

If the so-called ink media pack comprising a combination of printing medium and ink is mounted on the ink-jet printing apparatus, there is no need to replace the printing head when the ink media pack is replaced with another type one. Consequently, the ink media pack can be easily handled, compared with the conventional one, so that the utility of the media pack can be extensively increased.

According to the present invention, furthermore, a plurality of ink-reserving chambers is equipped in the ink tank mounted on the carriage. These ink-reserving chambers receive the supplies of ink in independent from each other. Therefore, the required and enough amount of ink can be easily and perfectly introduced into each ink-reserving chamber even if the amount of ink remained in each chamber is different from the others.

In the ink-jet printing apparatus of the present invention, when the ink tank or the integral-type pack comprising a combination of printing medium and ink is replaced with the new one, ink in the ink sub tank is not replaced with ink in the ink tank or the integral-type pack. In this case, the replacement of ink is only performed on the ink sub tank that requires such a replacement in accordance with an ink information pertaining to the variations of ink. Therefore, it eliminates a waste of ink.

By performing such an operation of ink replacement just before the printing movement, the replacement of ink can be only performed on the ink sub tank that requires the ink replacement by appropriately recognizing such a sub tank. The replacement of ink is not performed even if the ink tank or the integral-type pack is replaced with the new one several times. As a result, it eliminates a waste of ink. Eventually, furthermore, the duration of printing movement can be decreased as a whole by shortening the time required for the operation of ink replacement because the ink replacement is only performed on the ink sub tank that requires such an ink replacement.

The above and other objects, features and advantages of the present invention will become more apparent from the following description of embodiments thereof taken in conjunction with the accompanying drawings.

BRIEF DESCRIPTION OF THE DRAWINGS

FIG. 10B is a flow chart that illustrates the same process as that of FIG. 10A, excepting that the ink-jet printer of FIG. 1 is switched on;

DETAILED DESCRIPTION OF THE PREFERRED EMBODIMENTS

Hereinafter, we will describe the preferred embodiments of the present invention in detail with the reference of the attached drawings.

[First Embodiment]

Figure 1:
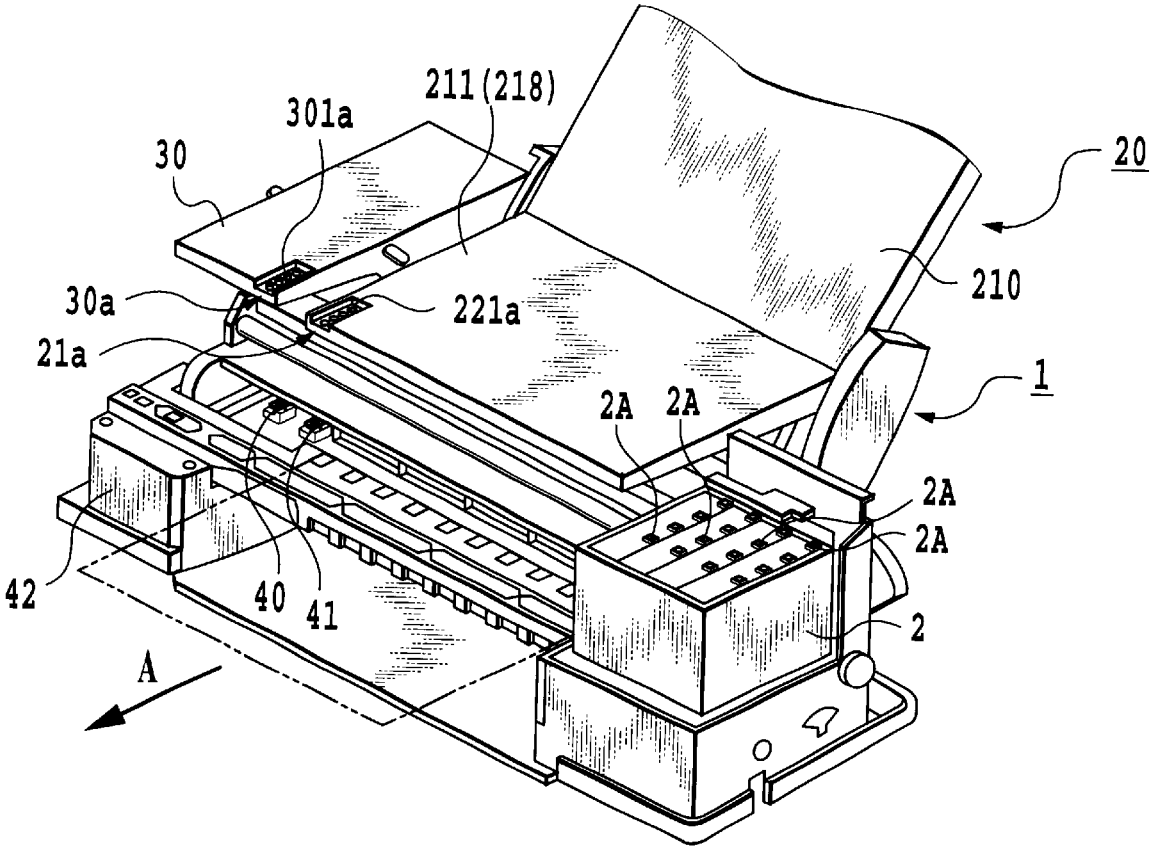
FIG. 1 is an external perspective view of an ink-jet printer as an embodiment of the present invention, chiefly illustrating the an feeding mechanism.
Figure 2:
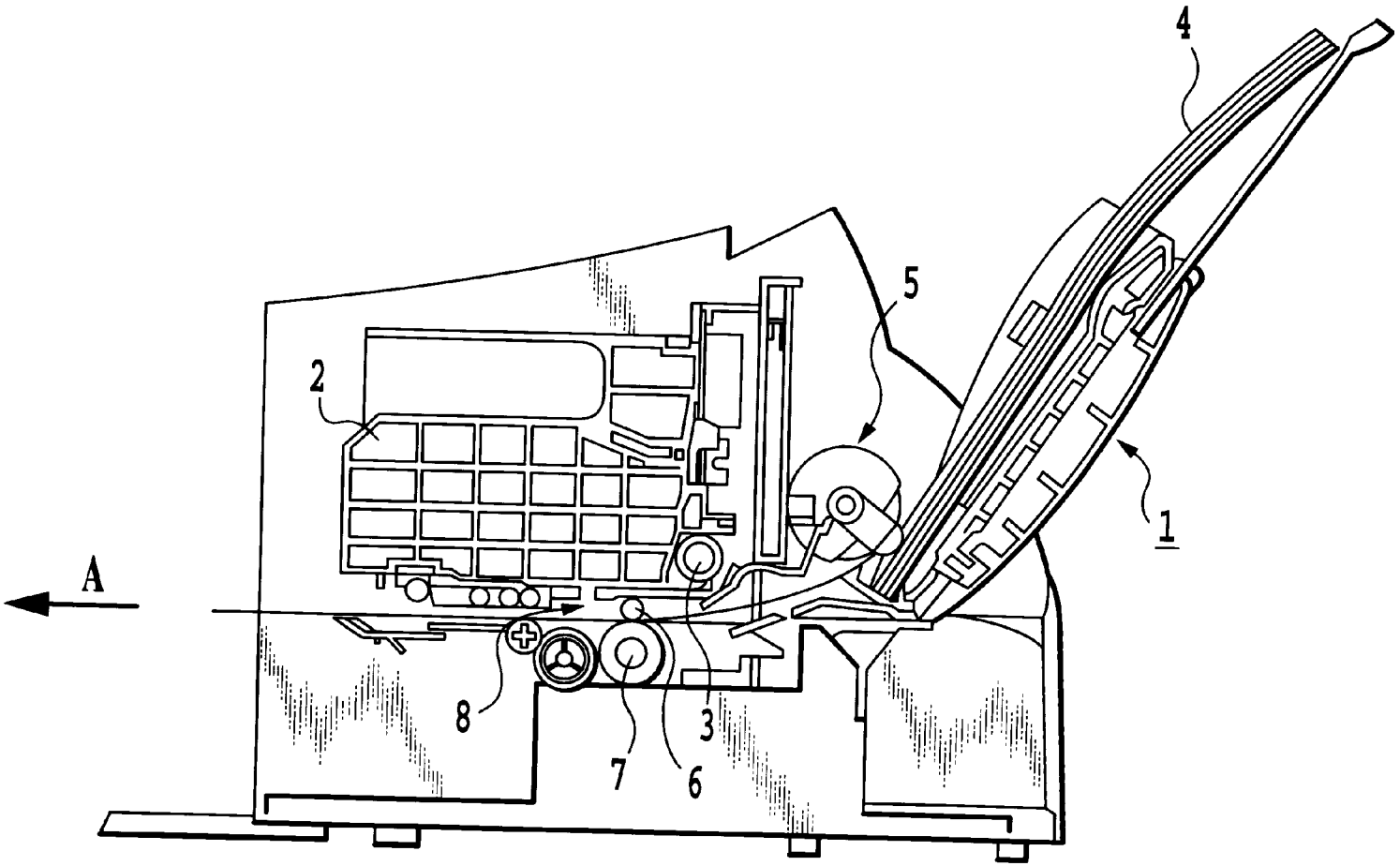
FIG. 2 is cross sectional side view of the lateral side of the ink-jet printer shown in FIG. 1.

FIG. 1 is a schematic perspective view showing an ink-jet printer that is one embodiment of a printing apparatus comprising an example of a sheet supplying device according to the present invention. FIG. 2 is a sectional view of an integral part of the printer shown in FIG. 1, principally showing a sheet feeding mechanism from a side of the printer.

As shown in FIG. 1, an ink-jet printer according to this embodiment can use a pack 20 (hereafter also referred to as an "ink media pack") comprising an ink housing section and a printing medium housing section integrated therewith for housing printing media such as paper, the pack being removably installed in the printer. That is, the ink media pack 20 is removably installed in an automatic sheet feeding device (hereafter also simply referred to as an "ASF") 1 installed in the printer main body. When the pack is installed, its printing medium housing section 210 lie along the position of the ASF 1, while an ink housing section 211 is separated from the printing medium housing section 210 in response to the installation operation as described later and maintains a horizontal position. Printing media housed in the ink media pack 20 are those selected in connection with a small pore diameter of an ink receiving layer or textiles used for textile printing as described above, and are used for relatively special applications. Correspondingly, inks housed in the ink media pack 20 can appropriately dye fine pores or fibrous materials constituting the textiles. In this manner, the ink media pack 20 is used to appropriately combine printing media with inks. To print an image on an paper, paper inks (inks for use on a paper) housed in the printer main body are used for an paper installed in the ASF 1.

FIG. 2 shows how the paper 4 is installed in the ASF 1 in the above case, wherein the paper 4 is directly installed in the ASF 1 with the ink media pack 20 removed from the printer. Additionally, the inks are housed in a paper ink refilling unit 30 previously installed in the printer main body and arranged in parallel with the ink media pack 20 as installed as shown in FIG. 1, and from which inks for a paper are supplied.

A carriage 2 is provided so as to be movable along a guide shaft 3 (see FIG. 2) provided in such a fashion substantially traversing the printer main body. The carriage 2 has four printing heads (not shown) for ejecting inks, which are mounted thereunder depending on the types of inks that can be simultaneously supplied. The printing heads can thus execute scanning by moving in a sheet width direction of printing media conveyed in a printing area 8 (see FIG. 2), while ejecting inks depending on printing information.

The carriage 2 of this embodiment has ink introduction portions 2A at its top as shown in FIG. 1. That is, the ink introduction portions 2A comprise four such portions (2ABk, 2AC, 2AM, 2AY) so as to correspond to the four printing heads, and are each in communication with a sub tank (not shown) formed adjacent to the corresponding each printing head, via an ink and air input port, as described later. The carriage 2 moves with predetermined timings as described later to move the ink supply ports to a position corresponding to a supply section 21*a* of the ink media pack 20 or a supply section 30*a* of the paper ink refilling unit 30. Additionally, at this corresponding position, an ink ejection port in the printing head also faces a cap 41 or a cap 40 corresponding to the paper 4. Thus, operations of supplying the ink to the sub tank for each printing head, replacing the ink, and recovering ejection can be performed as described later.

Specifically, for the ink supply and replacement as above, the carriage 2 moves to cause its ink introduction portion 2A to reach a position corresponding to the supply section 21*a* or 30*a*, and a carriage elevating mechanism (not shown) with a cam rotates the entire carriage 2 using a guide shaft 3 (see FIG. 2) as a rotation axis. An ink leakage preventing member of the ink introduction portion 2A is brought into tight contact with a joint section of the ink housing section of the ink media pack 20 or a joint section of the paper ink refilling unit 30. Subsequently, the cap 41 or 40 elevates to come into abutment with the printing head or the like mounted under the carriage 2, described later in FIG. 14 and other figures, thereby enabling the ink supplying or replacing operation.

Still, for the ejection recovering process, of course the carriage elevating mechanism does not operate but the cap 41 or 40 only elevate to come into abutment with the printing head. In addition, the tight contact between the ink introduction portion 2A and each of the above described joint sections can be canceled by performing an operation reverse to the above described one performed by the carriage elevating mechanism. Furthermore, this operation of a cam in the elevating mechanism is achieved by a driving force of a motor; driving control of the motor for elevating or lowering the carriage is performed and to move the carriage 2, driving control of the motor is performed for allowing the cam to retreat to a position where it does not engage with the carriage 2.

Additionally, for the ink supply and replacement as above, the pressure mechanism (not shown) provided in the printer main body and comprising the cam, the push-in pin, and others performs predetermined operations as described later in FIG. 14 and other figures. The operation for the ink supply or replacement is accomplished when the push-in pin engages with a predetermined member of the pressure section 221*a* of the ink media pack 20 or of the pressure section 301*a* of the paper ink refilling unit 30. Further, a recovery mechanism 42 is provided substantially under the caps 40 and 41. The recovery mechanism 42 comprises a suction pump or the like used for the above described ink supplying and replacing operations and ejection recovering operation.

With the above configuration, for printing, first, a sheet-feeding roller unit 5 (see FIG. 2) provided in the ASF 1 supplies printing medium directly from the ink media pack 20 or the ASF 1 to the printing area 8. Then, as shown in FIG. 2, for each scanning by the printing head installed in the carriage 2, the sheet-feeding roller 7 and the pressure roller 6 cooperate with each other in feeding a printing medium in a direction shown by an arrow A in the figure, by a predetermined amount for each feeding operation, so that images are sequentially printed on a printing surface of the printing medium, which is then discharged as shown by a chain double-dashed line in FIG. 1.

Figure 3:
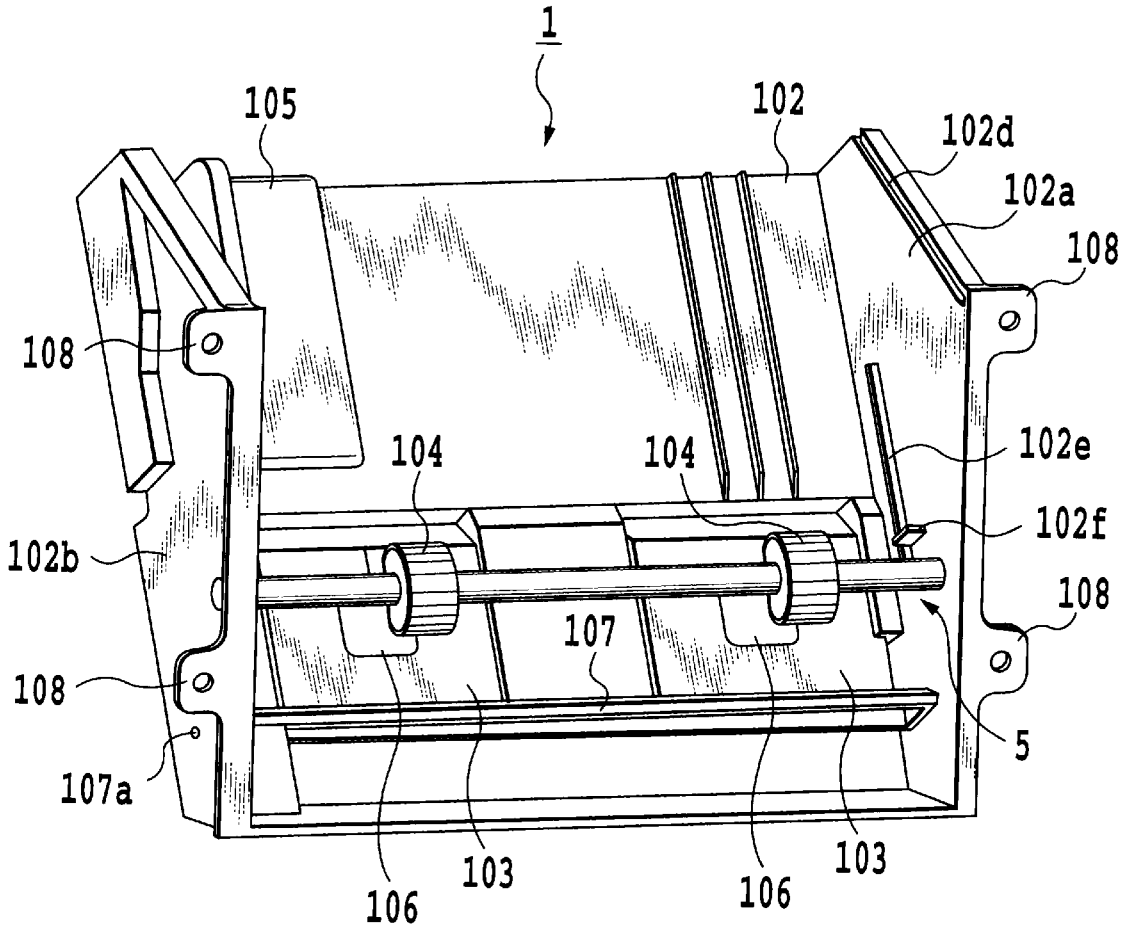
FIG. 3 is a perspective view of an automatic sheet feeder (ASF) of the ink-jet printer shown in FIG. 1.

FIG. 3 is a perspective view that illustrates the detailed configuration of an automatic sheet feeder (ASF)1.

As shown in the figure, the ASF 1 comprises a base 102, a pressure plate 103, a sheet-feeding roller unit 5, a movable side guide 105, a platen spring (not shown), a separation pad 106, a row of gears (not shown) that transmit a drive force, and so on.

The base 102 is arranged with the angle of inclination of 30° to 60° with respect to the printer's body. If sheets of ordinary paper are used, they are directly placed on the base 102. If sheets of the printing media in an ink media pack 20 are used, the base 102 supports the pack 20 itself. There is a position-regulating member that forms an isolation surface 107 below the base 102. The isolation surface 107 regulates the tip of ordinary paper by providing a predetermined resistance to that tip when the sheet-feeding roller unit 5 moves a sheet of ordinary paper directly placed on the ASF 1, so that sheets of ordinary paper can be separated one by one. In addition, the isolation surface 107 serves as a means of supporting lower ends of sheets of ordinary paper stacked on the isolation surface 107.

Furthermore, the position-regulating member that forms the isolation surface 107 is supported by a rotation axis 107*a* so that it rotates on the axis and spring-loaded by the springs (not shown) upwardly in the figure. Therefore, the position-regulating member keeps its predetermined orientation to hold the sheets of ordinary paper. If the ink media pack 20 is attached to the ASF 1, on the other hand, it is accompanied that the lower end of the ink media pack 20 forces the rotation of the position-regulating member in the downward direction in the figure against the force of the springs (not shown) to evacuate the isolation surface 107.

On the base 102, furthermore, the pressure plate 103 is provided above the position-regulating member that forms the isolation surface 107 described above. That is, the pressure plate 103 is arranged on the base 102 in such a manner that the pressure plate 103 is able to slide over the surface of the base 102 in the vertical direction. The sheets of ordinary paper or the printing medium held in the ink media pack 20 is pressed toward the sheet-feeding roller unit 5 by the forces of the pressure plate springs (not shown) provided on the back side of the pressure plate 103. That is, the pressure plate spring arranged on positions almost facing to roller portion 104 of the sheet-feeding roller unit 5. Thus, the sheets of ordinary paper of the printing medium held in the ink media pack 20 can be pressed toward the sheet-feeding roller unit 5 by the forces of the pressure plate spring.

The side guide 105 is arranged in the direction corresponding to the width of a sheet of ordinary paper to be placed on the base 102. That is, the side guide 105 is arranged on the base 102 so that it is able to slide in the horizontal direction in the figure. Thus, the position of ordinary paper in the width direction can be regulated in accordance with the dimensions of the ordinary paper when the ordinary paper is mounted on the ASF 1. That is, at first, right-side base plate 102*a* is used as a reference plane for mounting the ordinary paper on the ASF 1, and then one lateral side of the ordinary paper is brought into contact with the right-side base plate 102*a*. Subsequently, the side guide 105 is brought into contact with the other lateral side of the ordinary paper to restrict the position of the ordinary paper in the width direction. Therefore, the ordinary paper can be loaded in the ASF 1, appropriately.

The sheet-feeding roller unit 5 is rotatably supported by the right-side base plate 102*a* and the left-side base plate 102*b*. These plates 102*a*, 102*b* are integrally formed on both sides of the base 102, respectively. The sheet-feeding roller unit 5 is provided as a single-piece molded structure made of a plastic material or the like and comprised of a shaft rotatably supported by the plates 102*a*, 102*b*, a pair of roller portions 104 concentrically arranged on the shaft with the space between the roller portions 104. A sheet feeding roller unit rubber is provided on each of outer peripheral surface of the roller portions 104 so that the large friction is caused when the printing medium including the ordinary paper was fed. Concretely, each of the roller portions 104 has the outer peripheral surface which is shaped like a generally letter "D" or semicircular in cross section. Such a cross-sectional profile of the roller portion 104 permits to appropriately feed stacked sheets of the ordinary paper one by one. In addition, for example, the roller portions 104 (there are two roller parts in this example but not limited to) are respectively located at the distances of about 40 mm and 170 mm from an ordinary paper reference position on the right-side base plate 102*a* in the direction of the axis. If a comparatively large sized sheet of ordinary paper, for example A-4 size paper or the like is used as a printing medium, the sheet-feeding roller unit 5 feeds the paper using two roller portions 104 together. If a comparatively small sized sheet of ordinary paper, for example postcard-sized wide paper or the like is used, the sheet-feeding roller unit 5 feeds the paper using one roller portion 104 near the right-side base plate 102*a*.

At the time of loading the ordinary paper or the ink media pack in the AFS 1, the pressure plate 103 slides away from the sheet-feeding roller unit 5 against the force of the pressure plate spring by the action of a cam (not shown). The cam engages the sheet-feeding roller unit 5 through a driving force transmitting system (not shown). The action of the cam allows that, as described above, the pressure plate 103 is forced to slide on the base 102 away from the sheet-feeding roller unit 5 to release the pressure plate 103 from the unit 5 (i.e., the pressure plate 103 is in the released state). Rotational phases of the roller portions 104 in the sheet-feeding roller unit 5 is controlled when the pressure plate 103 on the base 102 away from the sheet-feeding roller unit 5. In this case, a linear portion (i.e., a chord portion of the semicircular profile) of the D-shaped outer periphery of the roller portion 104 is opposed to the pressure plate 103, allowing the space between the sheet-feeding roller unit 5 and the pressure plate 103 at a predetermined distance. As a result, ordinary paper or the ink media pack can be loaded into such a space. Furthermore, there are roller sensors (not shown) mounted on the sheet-feeding roller unit 5. Each of the roller sensor is able to detect the rotary phase of the corresponding roller portion 104 in the sheet-feeding roller unit 5 and a sliding position of the pressure plate 103 to be moved together with the sheet-feeding roller unit 5 in phase. Therefore, control timing in a paper-feed sequence of the ordinary paper or the printing medium in the ink media pack can be found.

When the ordinary paper is fed, the cam mentioned above performs a rotational motion to move the pressure plate 103 closer to the sheet-feeding roller unit 5 by the action of the pressure plate spring. It allows that the top surface of the ordinary paper on the top of stacked paper comes into contact with the roller portions 104 of the sheet-feeding roller unit 5. Subsequently, the rotation of the roller portions 104 apply frictional force on the ordinal paper in the paper-feeding direction (downward direction in the figure). In this state, substantial frictional forces are not applied on subsequent sheet of ordinary paper from the top, except that comparatively weak friction force usually arises between adjacent sheets. Thus, the transfer of the ordinary paper in the paper-feeding direction is blocked by the presence of the isolation surface 107 provided on the lower portion of the base 102. Consequently, the sheet-feeding roller unit 5 isolates and feeds only the top sheet of ordinary paper.

The printing medium feeding section receives the ordinary paper isolated and fed by the sheet-feeding roller unit 5. In other wards, the sheet-feeding roller unit 5 keeps rotating until the paper is introduced into the printing medium feeding section. Subsequently, the pressure plate 103 becomes in the released state as described above with respect to the sheet-feeding roller unit 5 and thus the remained ordinary paper on the base 102 becomes free of the rotational force of the roller portions 104 of the sheet-feeding roller unit 5. This condition is kept until an additional paper feed is required.

Accordingly, the ordinary paper comprising paper, synthetic resin, or the like placed on the pressure plate 103 of the ASF 1 is transferred by the sheet-feeding roller unit 5, and subsequently transferred by a sheet-feeding roller 7 (see FIG. 2) for performing a printing movement at a printing position facing to the printing head.

By the way, a separation pad 106 is provided on a portion of the pressure plate 103 facing to each roller portion 104 of the sheet-feeding roller unit 5. The separation pad 106 may be made of the material such as artificial leather having a comparatively large friction coefficient, such that it prevents the feeding of multiple sheets of ordinary paper when the number of sheets of loaded paper is decreased.

In the following, the configuration of the ink media pack 20 is explained. The pack 20 can be used if it is removably attached on the ASF 1 described above.

Figure 4:
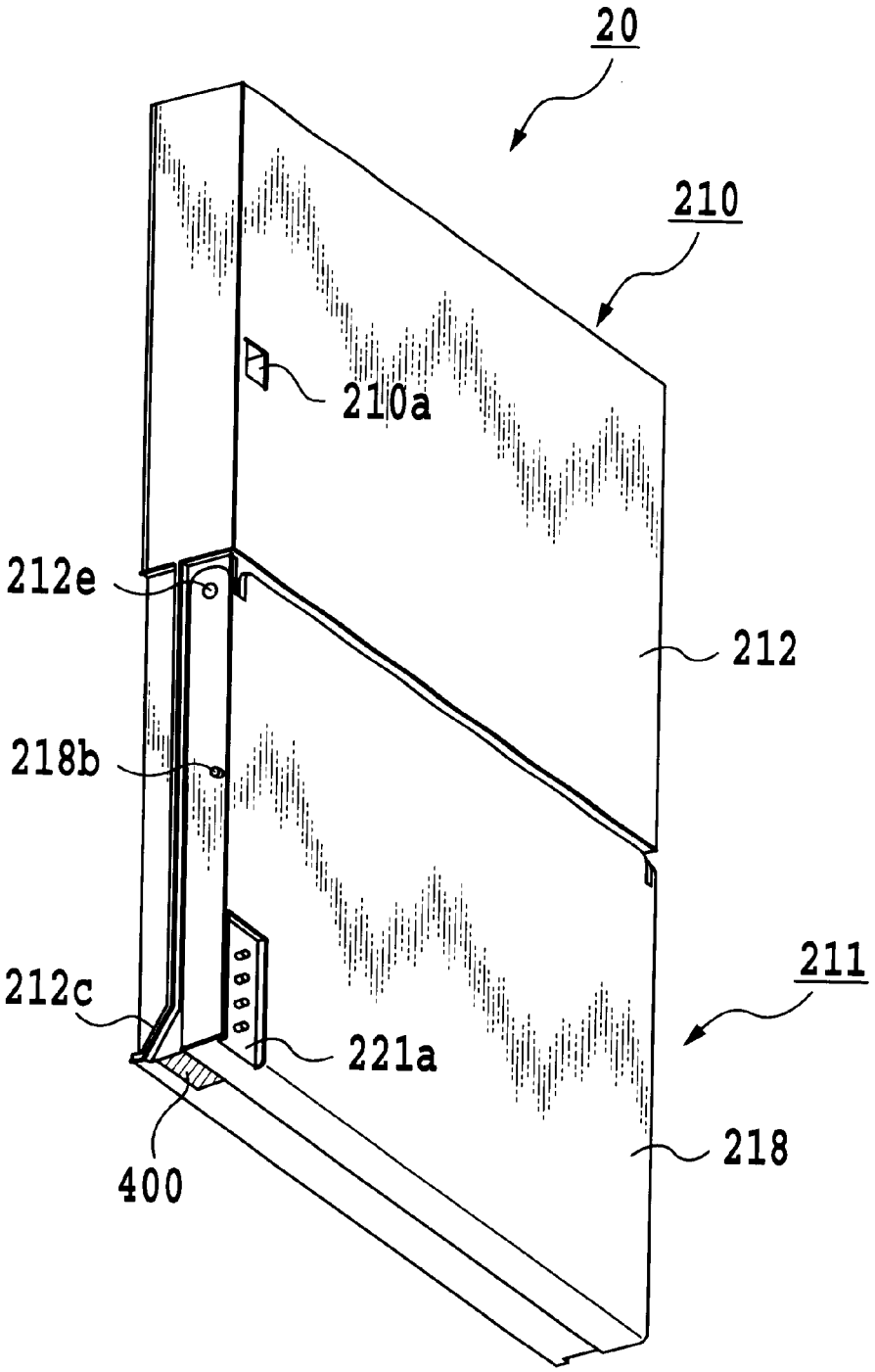
FIG. 4 is an external perspective view of the front side of the ink media pack to be removably attached to the ink-jet printer shown in FIG. 1.
Figure 5:
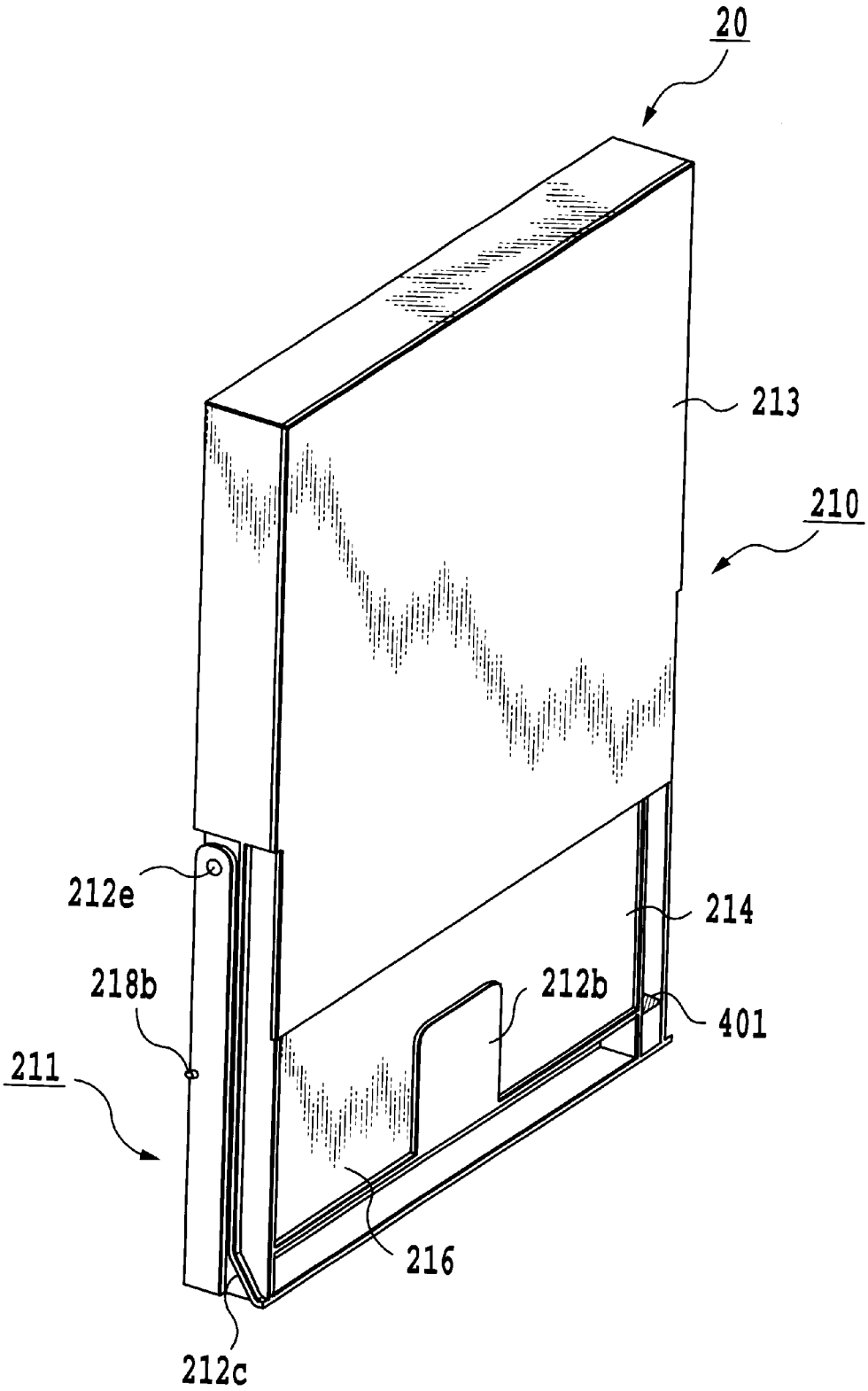
FIG. 5 is an external perspective view of the back side of the ink media pack shown in FIG. 4.
Figure 6:
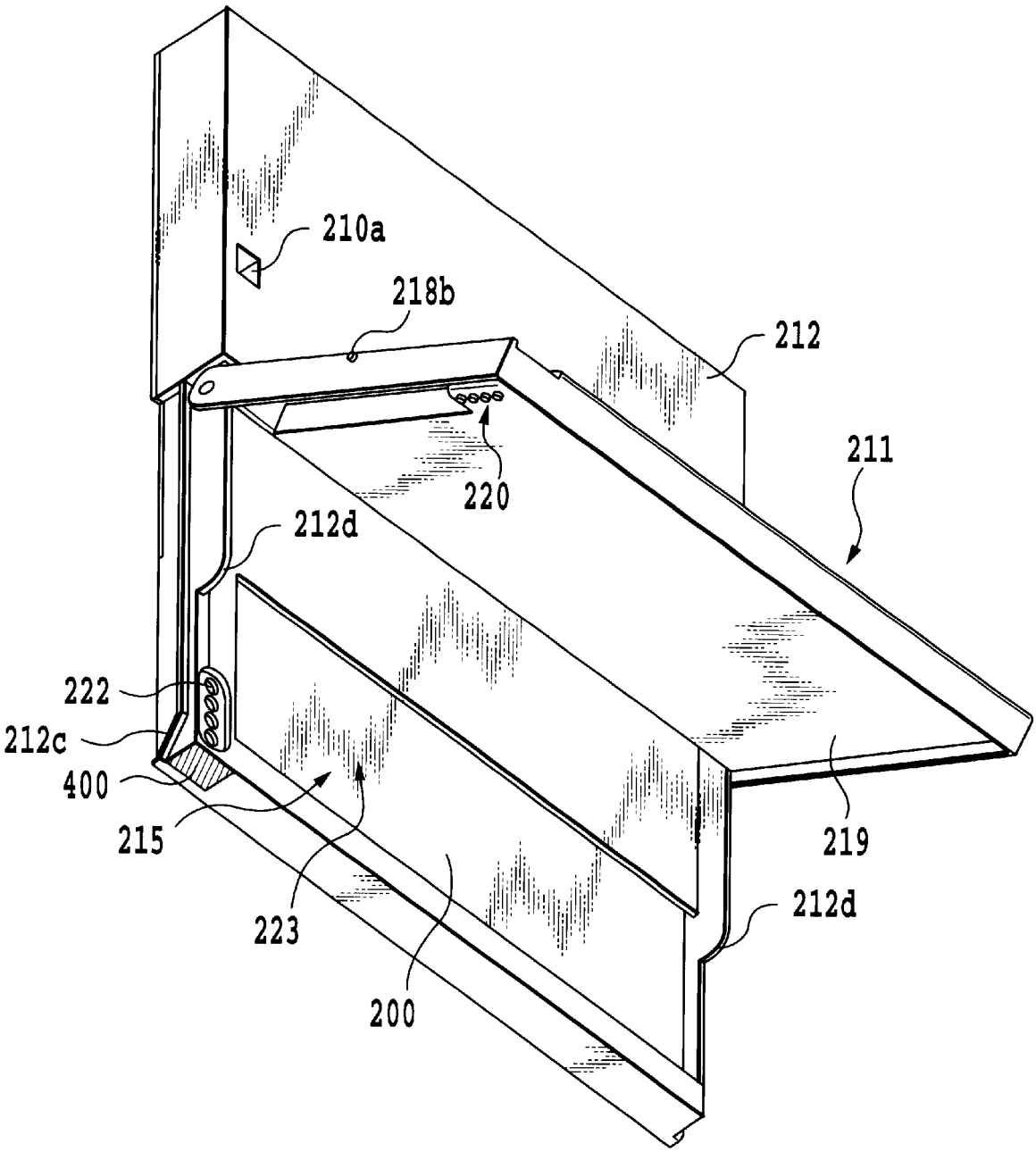
FIG. 6 is a perspective view of the ink media pack shown in FIG. 4 in a state of being opened.

FIG. 4 to FIG. 6 are provided for illustrating the configuration of the ink media pack 20, wherein FIG. 4 is a perspective view of the front side of the ink media pack; FIG. 5 is a perspective view of the back side thereof; and FIG. 6 is a perspective view of the ink cases that make up the ink-storage portion, where the ink cases are being opened.

The ink media pack 20 houses an optimal combination of printing medium and ink corresponding to various printing characteristics and enables the printing mode to be automatically set by means of its installation, as described previously. That is, this embodiment prevents a user from mistakenly determining a combination of printing medium and ink in principle if optimal types of ink in terms of the printing characteristics vary with the material or composition of printing medium even if the latter appear the same to the user, and also enables a printing mode suitable for the combination of installed printing medium and ink to be automatically executed when the user installs the selected ink media pack in the printer.

For a printing characteristic for images contained a high density of color, for example, if the printing medium depend on the permeability of the ink, then the optimal types of ink vary correspondingly, so that it is generally difficult for the user to select the optimal ink for the printing medium. In addition, if textiles are used as the printing medium, the optimal ink depend on the type of fibers constituting the textiles vary in respect to dyeing properties, even if the latter appear the same because the different fibers have different dyeing properties. The combination of the printing medium and ink in the ink media pack 20 may be, for example, ink containing reactive dyes and textiles that are dyed by means of covalent binding with the reactive dyes. In addition, textiles that are dyed by means of hydrogen or ionic bonding are combined with ink containing acid or direct dyes.

In FIGS. 4, 5, and 6, the ink media pack 20 generally comprises the printing medium housing section 210 and the ink housing section 211, which house printing medium and ink of an optimal combination as described above, respectively. A plurality of such ink media packs 20 are provided for different combinations so that one of them can be installed in the ASF 1 of the printer depending on a selection by the user.

The ink housing section 211 is structured to be entirely enclosed by an ink case 218. The ink housing section 211 internally has ink chambers 218*a* each corresponding to one of a plurality of inks housed therein, the chambers each having an ink tube that stores an ink, as will be seen FIG. 7. Additionally, the ink housing section 211, acting as a lid member, is provided so as to be opened and closed relative to the printing medium housing section 210 (see FIG. 6). That is, the ink case 218, acting as a lid member, is supported for free rotational movement by means of rotational movement axis 212*e* provided on opposite sides of the printing medium housing section 210, so that when the ink media pack 20 is installed in the printer, the ink case 20 moves rotationally in response to the installation operation to occupy a predetermined position (see FIG. 1). The ink case 218 has the pressure section 221*a* (see FIG. 4) in a corner portion in a rectangular top surface thereof, and a joint section 220 (see FIG. 6) in an opposite bottom surface. These sections are used for ink replacement and supply as described later.

On the other hand, the printing medium housing section 210 comprises: a media case 212 provided on the front side thereof and a rear cover 213 provided on the back side thereof, which cover the most part of the stored printing medium. In addition, there is an opening formed in the bottom part of the printing medium housing section 210. In other words, as shown in FIG. 6, a front opening 215 is formed on the lower part of the front side of the printing medium housing section 210. It is provided for the purpose of transferring a printing medium by contacting the roller portions 104 (see FIG. 3) of the sheet-feeding roller unit 5 with the printing medium 217 stored in the ink media pack 20 when the ink media pack is attached on the ASF 1. On the back side of the printing medium housing section 210, a back opening 216 formed as shown in FIG. 5. The back opening 216 is mainly provided for permitting that the pressure plate 103 of the ASF 1 presses the printing medium against the back.

The printing medium may be stored in the printing medium housing section 210 after placing a protective sheet 214 on the back side of the printing medium housing section 210 so that the sheet 214 is located between the printing medium and the back side. In addition, a stopper 212*b* is provided on the back opening 216. The protection sheet 214 and the stopper 212*b* prevent dusts from entering into the housing section 210 through the back opening 216 in addition to prevent the printing medium from dropping out of the opening 216. The protective sheet 214 may be made of the same material as that of the printing medium to be stored so that its friction coefficient may be appropriately adjusted with respect to that printing medium. Therefore, it is able to avoid a phenomenon in which the lowest part of the stacked printing medium being stored, which is the one directly contact with the protective sheet 214, cannot be transferred in an appropriate manner. In addition, it is also able to avoid a phenomenon in which the lowest printing medium tends to be transferred together with the movement of the printing medium stacked on the lowest one (i.e., it prevents the printing medium from multiple feed).

Furthermore, as shown in FIG. 6, there is a connector 400 on a part of the bottom end surface of the printing medium housing section 210. The connector 400 is provided for electrically connecting to a connector 310 (see FIG. 8) provided on the ASF 1. As described later, such an electrical connection allows the read out of various information stored in a predetermined memory device in the ink media pack.

A pack isolation surface 212*a* (see FIG. 8) is formed on one of the sides that partition the front opening 215 of the printing medium housing section 210. The pack isolation surface 212*a* is responsible for isolating the printing medium one by one and feeding the isolated printing medium by the same way as that of being applied on the ordinary paper as described above with reference to FIG. 3. Concretely, the pack isolation surface 212*a* is formed as a surface on which the downstream side of the printing medium stored in the printing medium housing section 210 strikes. The pack isolation surface 212 has an appropriate strike angle for isolating a sheet of the printing medium.

According to the present embodiment, by the way, a means for isolating a sheet of the printing medium from the stacked printing media is comprised of the isolation surface 107 shown in FIG. 3 and the isolation surface 212 described above. In an auto sheet feeder (AFS) having an isolation device such as an isolating craw, it is required that the isolating craw of the AFS should be kept apart at the time of loading the pack on the AFS. In this case, another isolating craw may be provided on the side of the printing medium storage part or a completely different isolating craw may be provided. According to the present invention, the isolation devices provided on both the AFS and the ink media pack are not limited to the designs of the above isolation surfaces. They can be designed as a combination of appropriate isolation devices.

Figure 7:
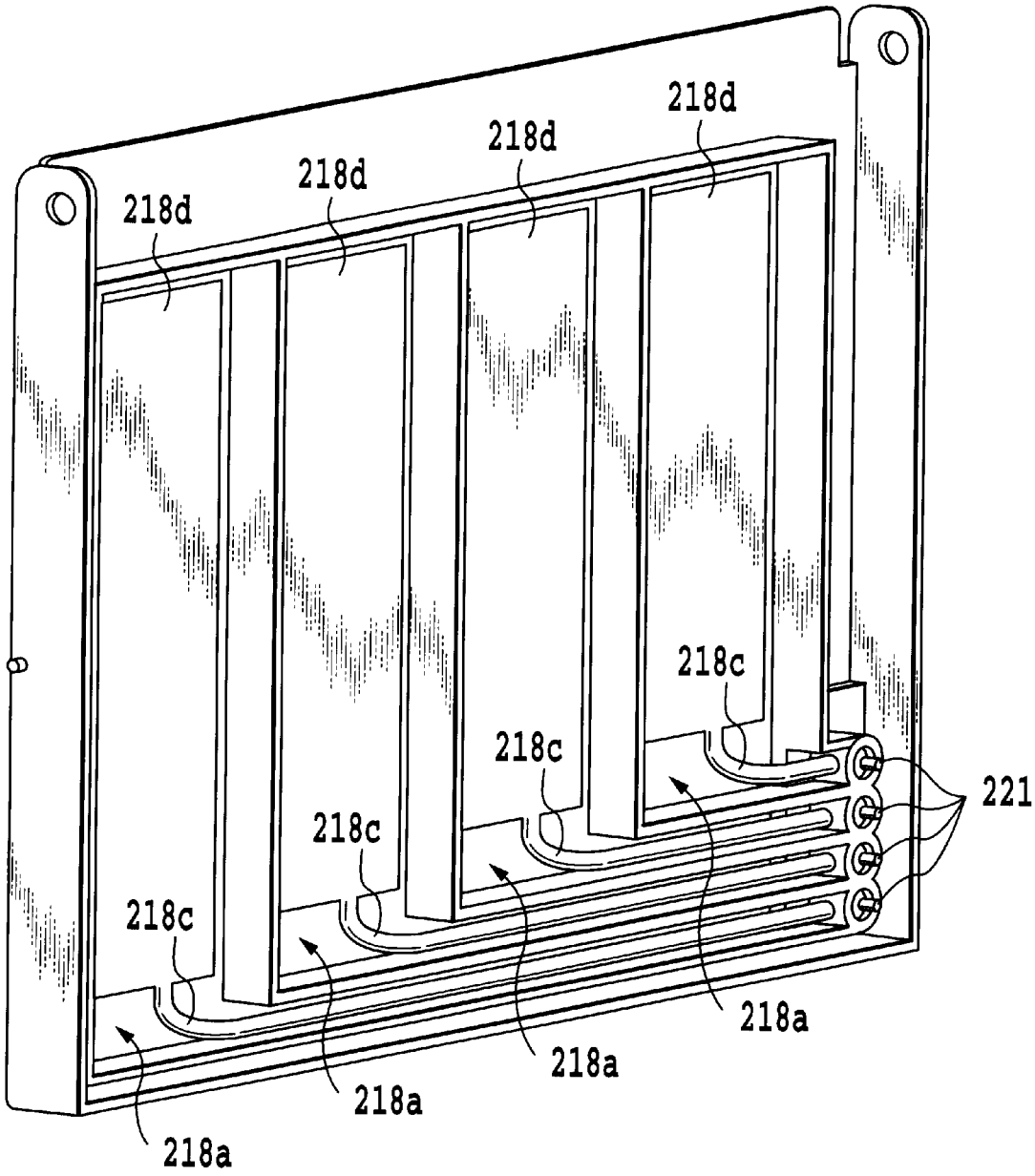
FIG. 7 is a perspective view of the inside structures of the ink-storage portions in the ink media pack shown in FIG. 4.

FIG. 7 is a view showing the internal structure of the ink housing section 211, wherein the ink case cover 219 (see FIG. 9) of the ink case 218 constituting the ink housing section 211 has been removed.

The ink case 218 has four ink chambers 218*a* formed inside depending on the colors of inks used for printing. The four ink chambers 218*a* store, for example, a yellow, cyan, magenta, and black inks. Of course, appropriate inks may be stored depending on the conditions of printing and the embodiment is not limited to the above inks. Each of the ink chambers 218*a* has an ink bag 218*d* arranged therein. The ink bag is formed of a flexible material and is partly bonded to a bottom surface of the ink chamber for fixation. The ink can be supplied from each of the ink bags 218*d* by connecting an ink supply tube 218*c* attached to one end of the ink bag 218*d*, to each corresponding joint valve 221. The joint valve 221 is in communication with the joint section 220, shown in FIG. 6, so that the carriage moves to dispose its ink supply port opposite to this joint section to be in a state of supplying ink to the printing head, as described previously in FIG. 1.

As described above, when the ink media pack 20 of the configuration shown in FIGS. 4 to 7 is not installed in the printer, the ink housing section 211 of the ink media pack 20 is closed relative to the printing medium housing section 210 to allow the ink housing section 211 to function as a lid for the printing medium housing section 210. That is, the ink housing section 211 prevents the printing medium 200 housed via the front opening 215 of the printing medium housing section 210 from being exposed to air.

Furthermore, a plurality of rubber caps 222 are provided at a position adjacent to the front opening 215 of the printing medium housing section 210 and corresponding to the joint section 220 of the ink housing section 211. Thus, when the ink housing section 211 is closed relative to the printing medium housing section 210, the rubber caps 222 encloses the joint section 220 to prevent the ink from leaking from the ink bag in each ink chamber 218*a*.

On the other hand, when the ink media pack 20 is installed in the ASF 1 of the printer, the ink housing section 211 is open relative to the printing medium housing section 210 (see FIG. 1). That is, the ink housing section 211 is supported for free rotational movement by means of the rotational movement axis 212*e* so as to be automatically opened relative to the printing medium housing section 211 with installation operation, thereby enabling the ink to be supplied to the above described printing head.

Although in this embodiment, the ink optimally combined with the printing medium are housed in the ink housing section, otherwise, washing ink may be housed therein to wash the printing head and the interior of an ink supply passage to the printing head when the ink is replaced. Additionally, if an ejection energy generating element for the printing head comprises an electrothermal converter and if the ink optimal for the printing medium may scorch the electrothermal converter, scorch-removing liquids or kogation-removing liquids may be housed which removes kogation from the electrothermal converter.

Next, an operation of installing the ink media pack 20 in the ASF 1 will be described principally with reference to FIGS. 3 to 6.

The ink media pack 20 is configured so as to be installed in and removed from the ASF 1 of the ink-jet printer, and configurations required for the installation and removal are provided in the ASF 1 and the ink media pack 20.

In the ASF 1 shown in FIG. 3, introduction guides 102*e* are provided on each of the base right-hand plate 102*a* and the base left-hand plate 102*b*. The introduction guides 102*e* engage with the corresponding guide ribs 212*c* provided at the opposite ends of the printing medium housing section of the ink media pack 20 when the latter is installed, thereby allowing the operation of installing the ink media pack 20 to be guided. That is, the guide ribs 212*c* of the ink media pack 20 guide the printing medium housing section 210 into the ASF 1. The guide ribs 212*c* engage with the corresponding introduction guides 102*e* and slide along them to enable the installation of the printing medium housing section 210 to be guided. The guide ribs 212*c* continue sliding until the butting ribs 212*d* (see FIG. 6) formed at the opposite side portions of the printing medium housing section 210 butt against the stoppers 102*f* (see FIG. 6) provided on the base right-hand plate 102*a* and the base left-hand plate 102*b*. This determines a position of the printing medium housing section 210 relative to the base 102 for installation and arrangement.

Figure 8:
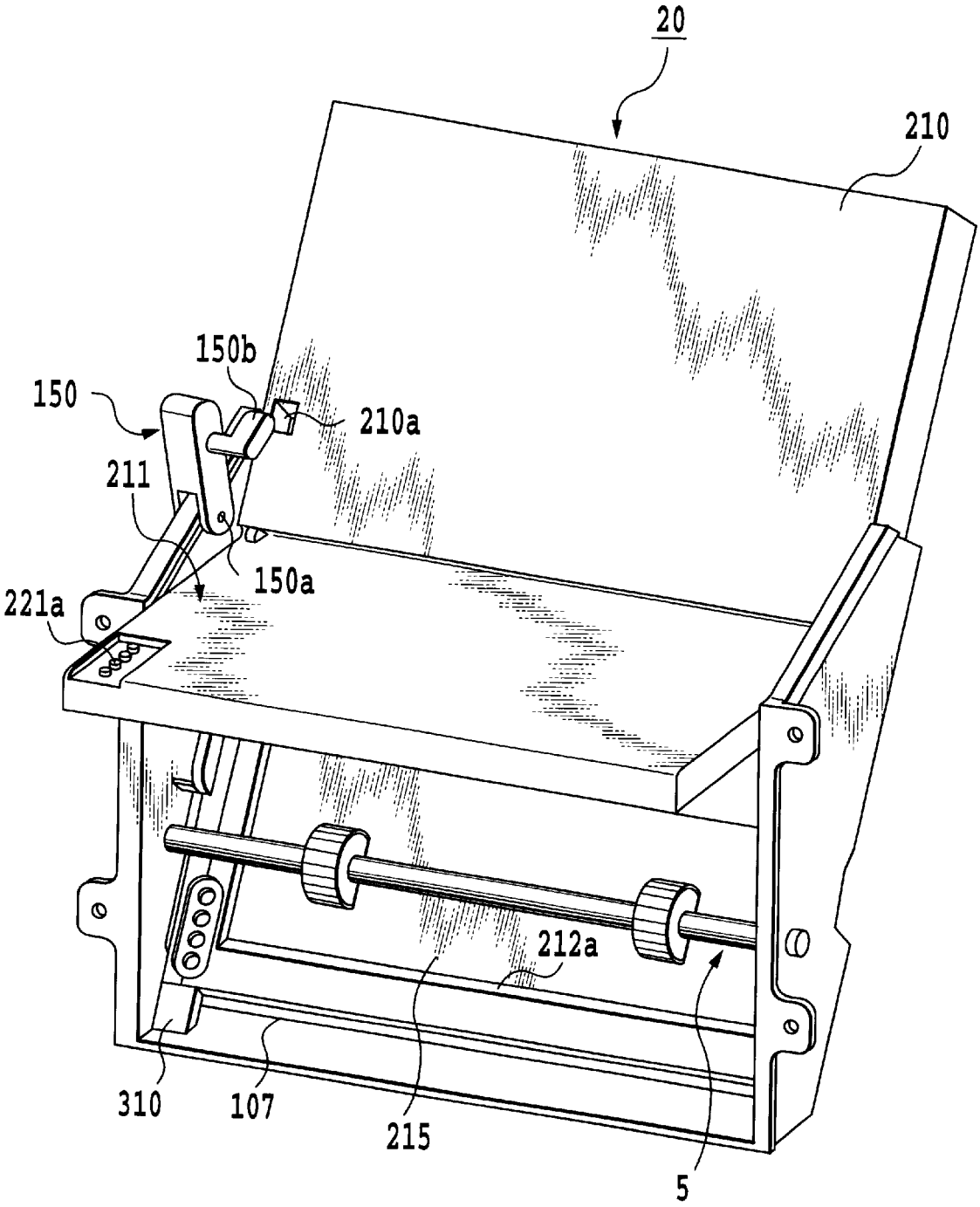
FIG. 8 is a perspective view of the ink media pack shown in FIG. 4 in a stage of being attached to the ASF of the ink-jet printer.

When the above described printing medium housing section 210 is installed, the connector 310 (see FIG. 8) for the printer provided in the ASF 1 and the connector 400 provided on the lower end surface of the printing medium housing section 210 are connected together, thereby allowing the printer to recognize that the ink media pack 20 has been installed. In addition, after this installation, the ink media pack 20 can be fixed to the ASF 1 by rotating, as shown in FIG. 8, a lock lever 150 in the direction shown by the arrow, the lock lever 150 being provided on the left-hand plate 102*b* of the ASF 1 and supported for free rotational movement by means of a lever shaft 150*a*, so that a projection 150*b* of the lever 150 is inserted into a lock hole 210*a* formed in the ink media pack 210. This fixation enables the above described connectors to be reliably connected together.

The input guide 102*e* is configured to leave a gap between itself and the uppermost sheet of paper 4 during maximum stacking so that when the paper 4 is directly mounted in the ASF 1, an operation of loading or feeding the paper will not be obstructed. When the side guide 105 is moved to the leftmost position in FIG. 3, it is housed in a side guide housing section (not shown) provided on the base left-hand plate 102*b*.

On the other hand, the operation of installing the ink housing section 211 of the ink media pack 20 is guided through the engagement between the guide grooves 102*d* formed in the base right- and left-hand plates 102*a* and 102*b* of the ASF 1 and guide bosses 218*b* provided on the opposite side portions of the ink case 218 of the ink housing section. That is, during the above described operation of installing the printing medium housing section 210, the two guide bosses 218*b* of the ink housing section 211 are engaged with the open ends of the two corresponding guide grooves 102*d* of the ASF 1 before sliding. Then, in response to the above described operation of inserting the printing medium housing section 210, the ink housing section 211 start to be opened as the guide bosses 218*b* are guided, and are automatically rotated around the rotating shaft 212*e*. Once the insertion operation has been ended, the ink housing section 211 assumes a substantially horizontal determined position, shown in FIG. 1, to complete the installation.

FIG. 8 is a view showing how the ink media pack 20 is installed in the ASF 1 by means of the above described installation operation.

As shown in this figure, in the installed state, the ink housing section 211 is open relative to the printing medium housing section 210 and the front opening 215 of the printing medium housing section 210 is opposite to the roller section 104*a* of the sheet feeding roller unit 5. Additionally, in this state, the rear opening 216 is opposite to the pressure plate 103. That is, since the opening area of the rear opening 216 is larger than that of the pressure plate 103, when the pressure plate 103 enters a pressing state, it presses the rear surface of the housed printing media 200 housed via the protective sheet 214, thereby enabling the surface of the housed printing media 200 to be connected with the roller section 104*a* compressibly without displacing the ink media pack 20.

The ink housing section 211 is guided as described previously and then held in a substantially horizontal direction, so that a tip portion of the ink housing section 211 which includes the joint section 220 and the pressure section 221*a* can assume a position for entering the ink-jet printer main body. That is, the tip portion can be located above a moving range of the carrier 2. Furthermore, as described later, a cam mechanism (not shown) provided in the printer main body presses the pressure section 221*a*, to activate the joint section 220 to thereby enable the ink to be supplied via the ink introduction portion 2A on the carriage 2.

For remove the ink media pack 20 from the ASF 1, the above described operation is reversed.

Figure 9:
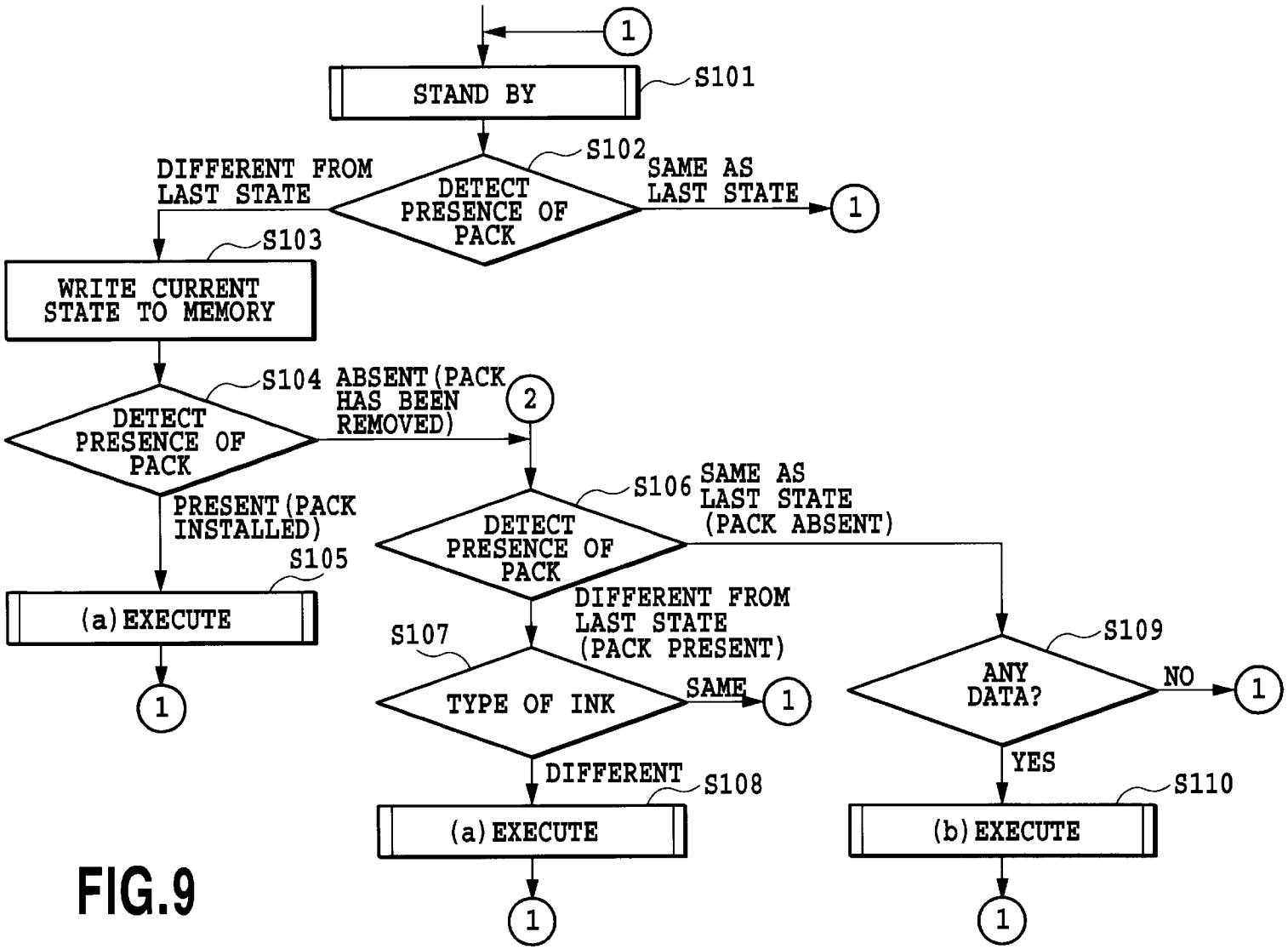
FIG. 9 is a flow chart that illustrates the process including the steps of ink replacement and so on when the ink media pack is attached or detached during the standby of the printing movement of the ink-jet printer shown in FIG. 1.
Figure 10A:
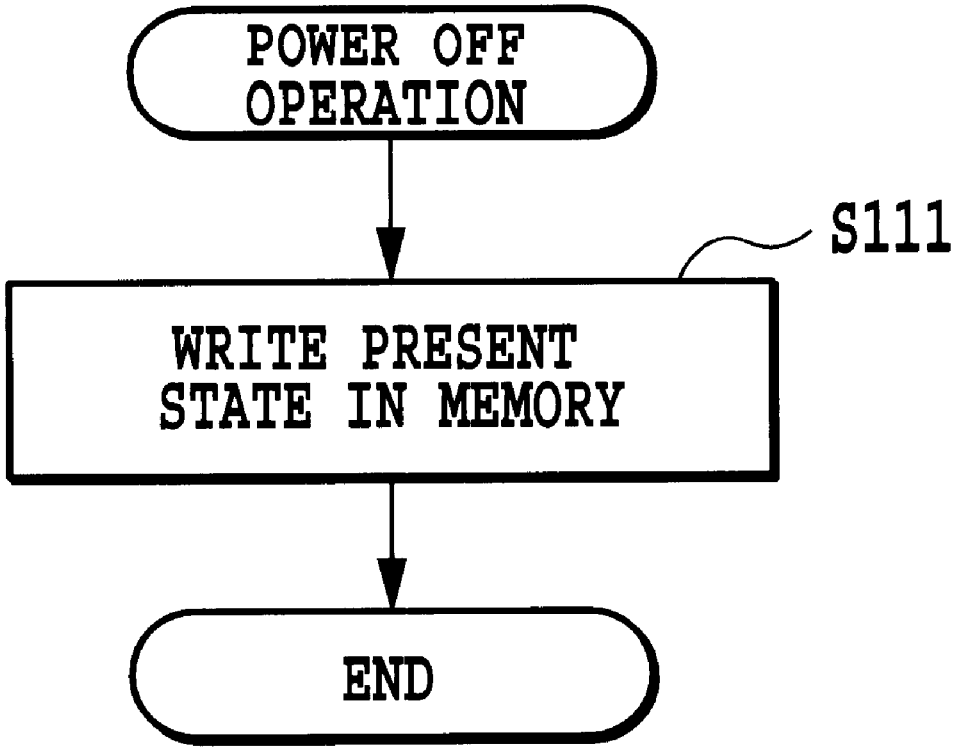
FIG. 10A is a flow chart that illustrates the process including the steps of ink replacement and so on during the period that the ink-jet printer of FIG. 1 is switched off.
Figure 10B:
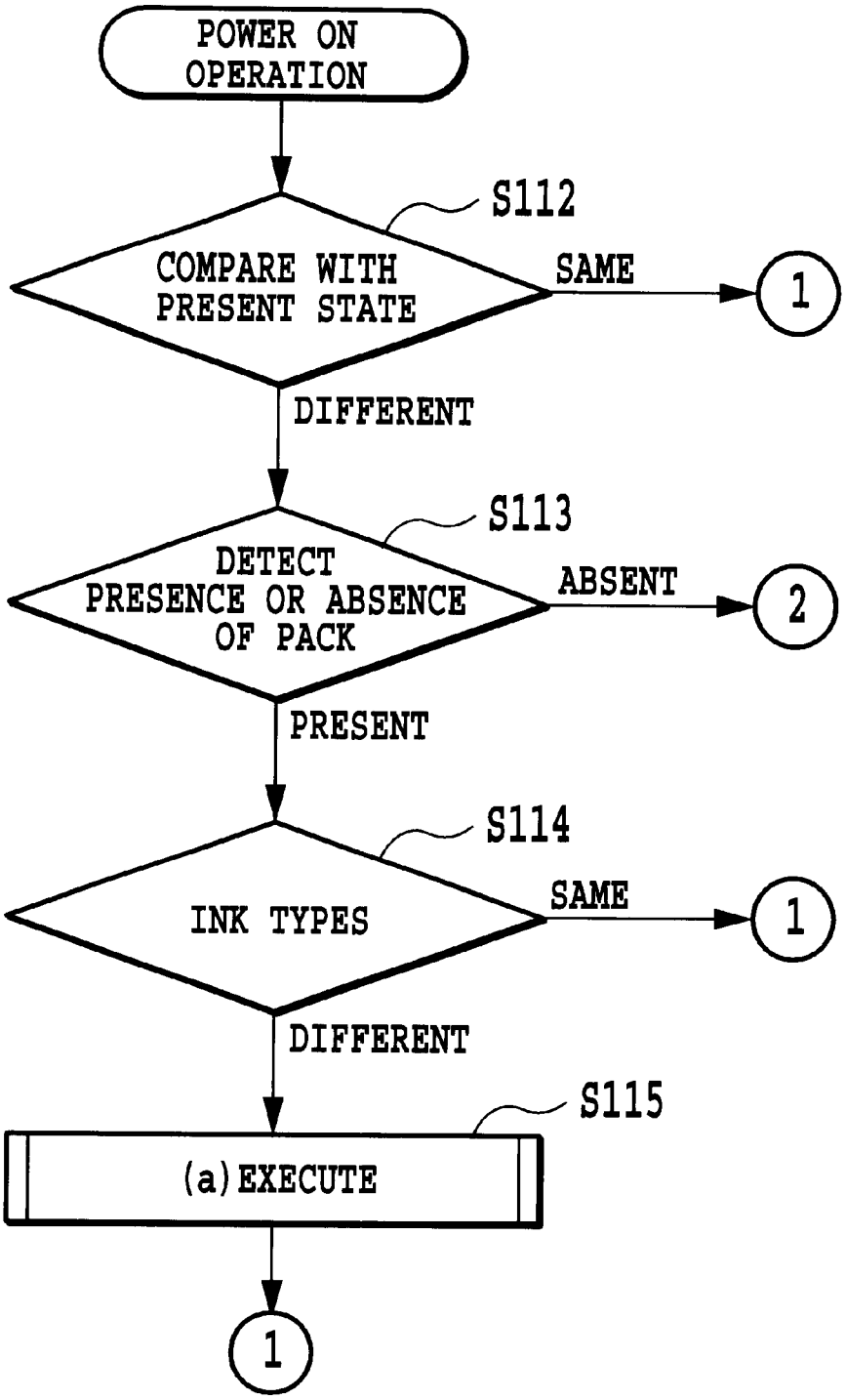

FIGS. 9 and 10 are flow charts showing processes executed by the printer in connection with the installation of the above described ink media pack 20 or the like. FIG. 9 shows a process executed when the installation of the ink media pack 20 or the like is carried out while the power to the printer is on. FIGS. 10A and 10B show a process procedure executed when the installation of the ink media pack 20 or the like is carried out while the power to the printer is off. These processes can be executed by electrically connecting a connector 400 provided in the ink media pack 20 to the connector 310 of the printer.

As shown in FIG. 9, if the installation of the ink media pack 20 or the like is carried out while the power is on, it is executed as part of a printer printing standby process (step S101). That is, this process is activated at predetermined time intervals during printing standby to first determine whether or not the ink media pack 20 has been installed in the printer (S102). This determination process is executed using data on installation/non-installation which are written to a predetermined memory of the printer together with data such as the ID of the ink media pack and the types of the ink and printed medium. If it is determined that these data are different from the last ones, the current state, including the ID of the ink media pack 20 (if installed), is written to the above memory (S103). The above described memory is then referenced to determine whether or not the ink media pack 20 is currently installed (S104). The determination of the installation/non-installation of the ink media pack 20 may be based on the state of the switch 315 for detecting the installation, as described later in FIGS. 11 and 12.

If it is then determined that the ink media pack 20 is installed, it is determined that the state where the ink media pack 20 is not installed has been changed to the state where it is installed and a process A, described below, is executed and the standby process at step S101 is continued.

On the other hand, if it is determined at step S104 that the ink media pack 20 has been removed, two cases are possible: ① the ordinary paper 4 has been installed and ② an operation of changing the ink media pack 20 to a different type is being performed. Thus, step S106 and subsequent steps are executed.

That is, to distinguish the cases ① and ② from each other, the presence of the ink media pack 20 and the presence of the printing data are monitored (S106 and S109). When whether or not the ink media pack 20 is present is detected at step S106 and if it is determined that the state is the same as the last one, that is, the ink media pack 20 has been removed and it is further determined that the printing data has been transmitted from the host (S109), then it is determined that the paper 4 is installed and a process (b), described below, is executed.

In addition, if the presence of the ink media pack is detected at step S106 before the printing data are transmitted, then it is determined that the ink media pack 20 has been installed. It is then determined at step S107 whether or not the types of the inks in the ink media pack are the same as those in the previously installed ink media pack. Then, the process (a) is executed only if the types of the inks are different. If the types of the inks remain unchanged, since the inks in the printing head need not be replaced, and the standby process is thus continued.

Next, the process executed when the installation of the ink media pack 20 or the like is carried out while operating of printer power of f or on will be described with reference to FIGS. 10A and 10B.

As shown in FIG. 10A, when a power-off operation is performed, data on the current installation state of the ink media pack 20 is written to the above described memory (S111) and the power is then shut off. The ink media pack 20 may be installed or removed while the power is off.

Then, when a power-on operation is performed, the process shown in FIG. 10B is activated to compare the current installation state of the ink media pack 20 with the installation state written at the above step S111, at step S112. At that time, if the installation state of the ink media pack 20 is the same, the inks in the head need not be replaced and the procedure shifts directly to the standby process shown in FIG. 9 to end the present process.

On the other hand, if the installation state of the ink media pack 20 is different, it is determined whether or not the ink media pack 20 is present (S113). At this time, if the absence of the ink media pack 20 is detected, it is considered that two cases are possible: ① the ordinary paper 4 has been installed and ② the operation of changing the ink media pack 20 to a different type is being performed. Thus, the procedure shifts to the processing at step S106 shown in FIG. 9, as described in FIG. 9.

If the presence of the ink media pack 20 is detected, then the information on the types of the inks in the ink media pack 20 are compared with the information on the ink types written at step S111 (S114). At this time, if the ink types are the same, the inks in the printing head need not be replaced and the procedure shifts to the standby process to end the present process.

On the other hand, if the ink types are different, after the process (a), described below, is executed and the procedure then proceeds to the standby process in order to replace the inks in the printing head.

Next, the above mentioned processes (a) and (b) will be explained mainly with reference to FIG. 1.

Process (a)

This process is executed if the ink media pack has been replaced with a different type. First, the carriage 2 moves to the positions of the cap 41 and recovery system 42 for the media pack. While moving for each ink color, the carriage 2 sucks the ink from the printing head side to empty the printing head and the sub tank and then supplies each color ink at the same ink supply position, as described later. Once each color ink supply has sufficiently finished, the carriage 2 moves to its home position to execute the above mentioned standby process for the printing command.

During the standby process at the above described step S101, when the printing command is issued, the printed media 200 are fed from the ink media pack 20 and printing is then carried out. After the printing has been completed, the media are discharged. During the printing, if the ink must be supplied to the sub tank, then the carriage moves to the ink supplying position to supply each color ink as described above.

Process (b)

This process is executed if the paper 4 is directly installed in the ASF 1 and if images or the like are printed on the paper. First, the carriage 2 moves to the positions of the cap 41 and recovery system 42 for the ordinary paper. While moving for each ink color, the carriage 2 sucks the ink from the printing head side to empty the printing head and the sub tank and then supplies each color ink at the same ink supply position, as described later. Once each color ink supply has sufficiently been finished, the carriage 2 moves to its home position to execute the above mentioned standby process for the printing command.

Figure 11:
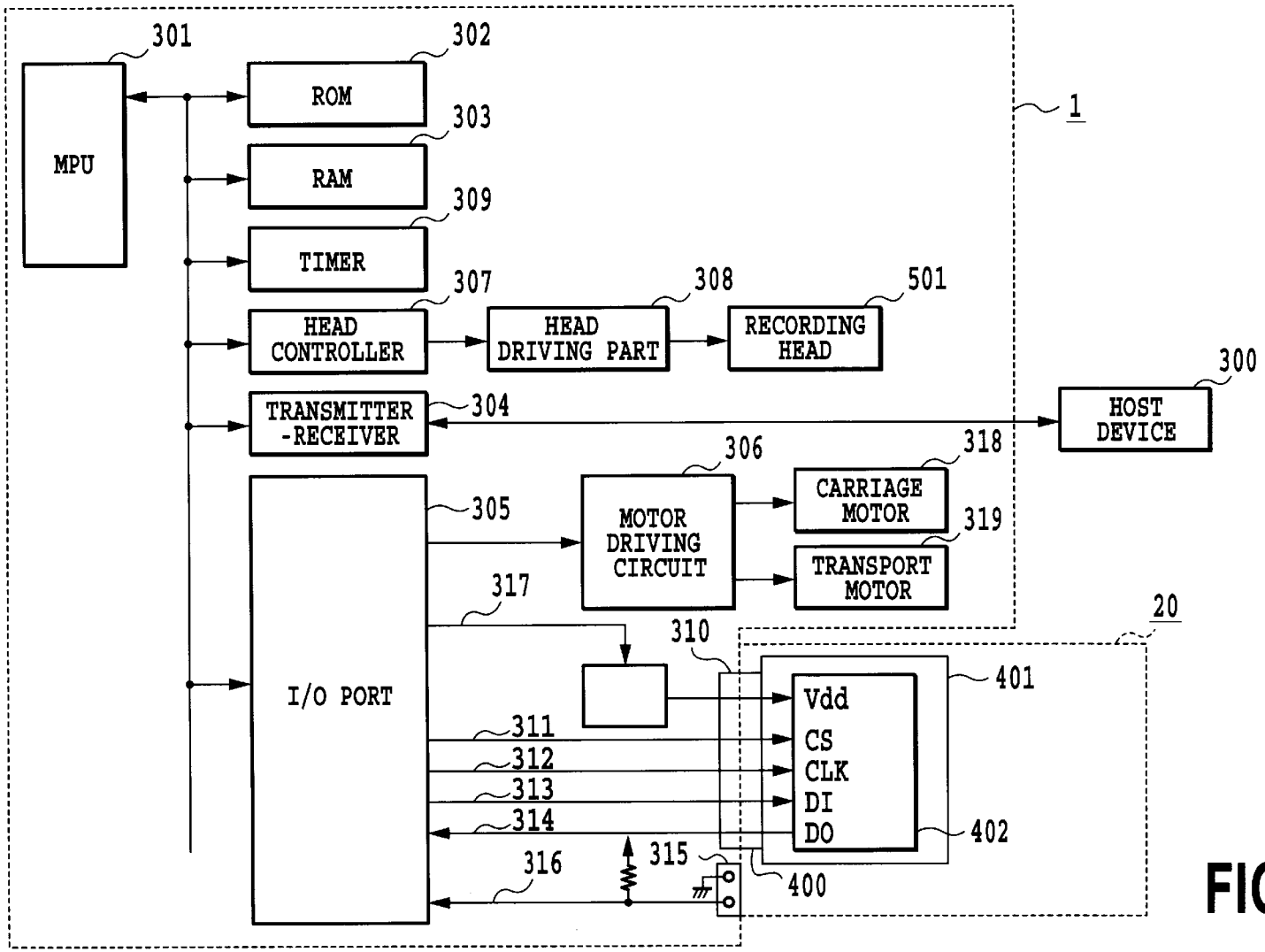
FIG. 11 is a block diagram of a control system constructed of the printer of FIG. 1 and the ink media pack of FIG. 4.

FIG. 11 is a block diagram of a system comprising an ink media pack and an ink-jet printing apparatus according to the present invention, principally showing a control configuration of the system.

In the ink-jet printer, a microprocessor (MPU 301) controls the entire ink-jet printer in accordance with a control program stored in a ROM 302. A RAM 303 includes a receive data buffer saving printing data transferred from a host device 300 and is used as a work area in which the MPU 301 performs its processes.

The MPU 301 controls rotation of a carriage motor and of a conveyance motor for also supplying a rotational movement force to the sheet feeding roller gear C112, via an I/O port 305 and a motor driving circuit 306, based on command and printing data transferred from the host computer (host apparatus) 300 via a transmission and reception means 304 comprising a well-known centronics interface or the like, in accordance with the procedure of the program stored in the ROM 302. The MPU 301 also outputs the printing data to a printing head 501 via a head control section 307 and a head driving section 308 to control a printing operation of the printing head. In addition, a timer 309 is provided for producing a drive pulse width for the printing head and controlling the rotation speed of each motor.

On the other hand, in the system of the ink media pack 20 connected to the above described ink-jet printer to work, an EEPRPOM 402 is mounted which enables electric reads and writes when mounted on a printed circuit board 401 (see FIG. 5) and which can retain data even while no voltage is being applied thereto. A connector 400 is provided on the circuit board 401 for electrical connecting with the printer body. The EEPROM 402 of this embodiment is of a general serial type that is operative when a CS signal is at an "H" level. That is, when the CS signal is at the "H" level, a CLK signal 312 rises, a command (write, read, delete, or the like) on a DI input signal 313 or write data is written to the EEPROM 402, and read data are output onto a DO output signal 314, from which they can then be read. Signal lines 311 to 314 are each connected to the I/O port 305 in the main body via the connector 310 of the main body to accomplish a data read and write under the control of the MPU 301. The serial EEPROM 402 has a capacity of about several-K bits and can be rewritten about $10^5$ to $10^7$ times; it is thus suitable as a rewritable storage element for storing information on the printer of this embodiment.

Furthermore, the ink-jet printer has a switch 315 for detecting that the ink media pack 20 is installed, the switch 315 being activated when the ink media pack 20 is installed. An output signal 316 from the switch 315 is input to the I/O port 305. The MPU 301 reads this signal to detect the installation or removal of the ink media pack 20. At the time of detecting the installation of the pack 20, the MPU 301 uses an output signal 317 from the I/O port 305 to supply power to the EEPROM 402 in the pack 20 to enable a read from or a write to the EEPROM 402.

The information stored in the EEPROM 402 in the ink media pack 20 is roughly divided into that written thereto in a factory when the pack is manufactured and which is subsequently simply read out by the ink-jet printer, and that rewritten by the ink-jet printer after the pack has been installed in the ink-jet printer. The former information is represented by the types of printing medium and ink set in the pack.

Figure 12:
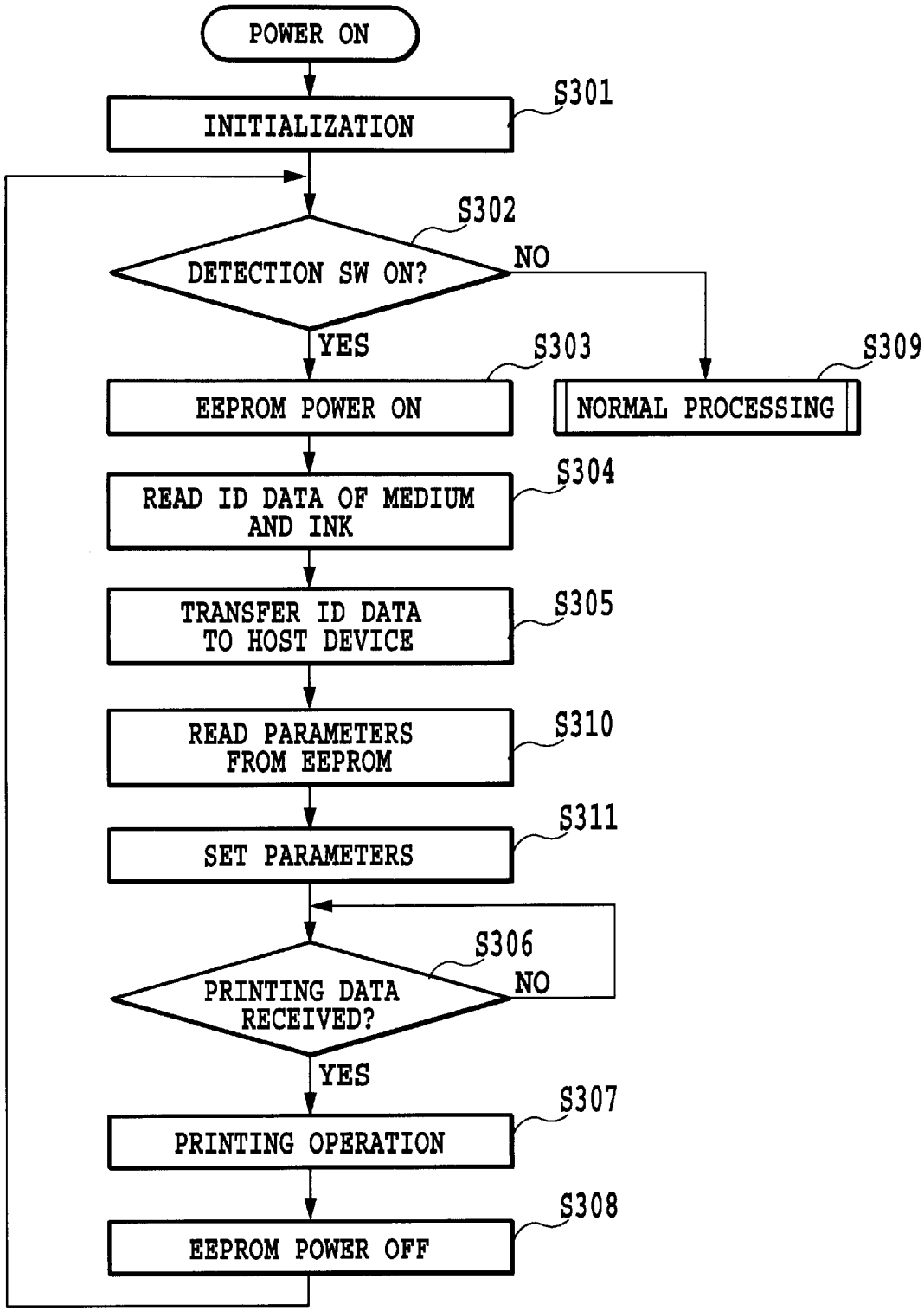
FIG. 12 is a flow chart that illustrates the process mainly performed during the standby of printing movement of the ink-jet printer shown in FIG. 1.

FIG. 12 is a flow chart schematically showing a printing process executed by the ink-jet printer of this embodiment and showing a control procedure executed by the MPU 301. The process shown in this figure relates mainly to setting of a printing mode prior to printing and is executed substantially parallel with the process for printing standby described above in FIGS. 9 and 10.

After the power supply to the ink-jet printer has been turned on, the MPU 301 initializes the apparatus (S301). Then, the MPU reads state of the pack installation detecting switch 315 via the input port 305 (S302) When the switch 315 is active (ON), the MPU determines that the pack 20 is installed and supplies power to the EEPROM 402 (S303) to read various data stored in the EEPROM 402 (S304). The EEPROM 402 has various data such as the IDs of the types of printing medium and ink accommodated in the ink media pack 20 and printing control parameters stored before shipment. The MPU transfers the data read from the EEPROM 402 to the host equipment 300 via the transmission and reception means 304 such as a centelectroronics interface (S305). A printer driver in the host equipment 300 automatically creates optical printing data without the user's selections, based on the ID information stored in the EEPROM 402 before shipment and including the types of printing medium and ink in the pack 20, and then transfers the data to the ink-jet printer. That is, the host equipment 300 creates optimal printing data and transfers then to the ink-jet printer, taking into consideration optimal image processing for a combination of printing medium and ink in the pack 20 installed in the ink-jet printer, the amount of placed ink, and the number of print passes (the number of passes for the multi-pass method). In addition to or as alternatives to the above described IDs of the types of printing medium and ink, image processing parameters such as the amount of placed ink and the number of print passes may be transmitted to the host equipment 300 and stored in the EEPROM 402.

Next, the MPU reads various parameters on the printing operation of the ink-jet printer (S310). These parameters were stored in the EEPROM 402 before shipment and include, for example, a drive pulse width for the printing head, the number of dots for auxiliary ejection which is used when an auxiliary amount of ink is ejected to prevent the printing head from failing to eject the ink, time intervals for the auxiliary ejection, time intervals for recovery and suction operations required to keep the printing head normal. The MPU sets these parameters in a printing control circuit 307 of the ink-jet printer (S311). This, in combination with the optimization executed by the printer driver, enables more optimal control.

Subsequently, the MPU waits for the printing data to be received from the host equipment 300 (S306), and upon receiving the printing data, executes a printing operation based thereon (S307). Once printing for one page has been completed, the power supply to the EEPROM 402 is turned off (S308). Subsequently, the process returns to step S302 to read the state of the pack installation detecting switch 315 via the I/O port 305.

On the other hand, when the pack installation detecting switch 315 is inactive (OFF) at step S302, the MPU determines that the pack 20 is not installed and executes a normal printing operation (S309). That is, the ink-jet printer is set to be able to print the printing data with the print grade and speed designated by the user via the printer driver of the host equipment 300 and then executes printing using the ink from the plain-paper and ink refilling unit 30 of the ink-jet printer and the printing medium set in the ASF 1.

The above control sets the ink-jet printer to be able to print, without the user's designations, the printing data optimized depending on the combination of the ink and printing medium set in the ink media pack, thereby enabling printing with high-grade image quality. In the steps S310, the following printing parameters for the ink-jet printing printer stored in the ROM 302 are also programmed on the basis of the data for types of printing media and ink read out by the MPU 301. That is, the printing parameters include a driving pulse width of the printing head, the number of dots formed by a preliminary ejection of ink for preventing the printing head from ink-ejection failure (the number of preliminary ejecting dots), time intervals of the preliminary ejection, a time intervals of recovering and sucking operations to keep the ejection condition of the printing head properly, and so on. In this case, the control procedure may be further optimized with the optimization of the printer driver.

In this embodiment, by the way, identification data (ID) concerned about the types of ink and printing medium stored in the ink media pack are read out and then parameters for printing control stored in the ROM 302 are read out and set on the basis of the above ID. According to the present invention, however, the above parameters may be previously stored in the EEPROM 402 of the ink media pack and then directly read out of the EEPROM 402 to set them in a print control circuit of the ink-jet printer. This process allows the control of printing optimized for a combination of printing media and ink even if such a combination thereof is newly designed and installed in the pack after shipment or sale of the ink-jet printer and additionally provided to the user.

In embodiments other than those described above, the information rewritten by the ink-jet printer with the pack 20 installed therein includes the number of printing medium in the pack 20 and the amount of ink remaining in the pack 20.

Figure 13:
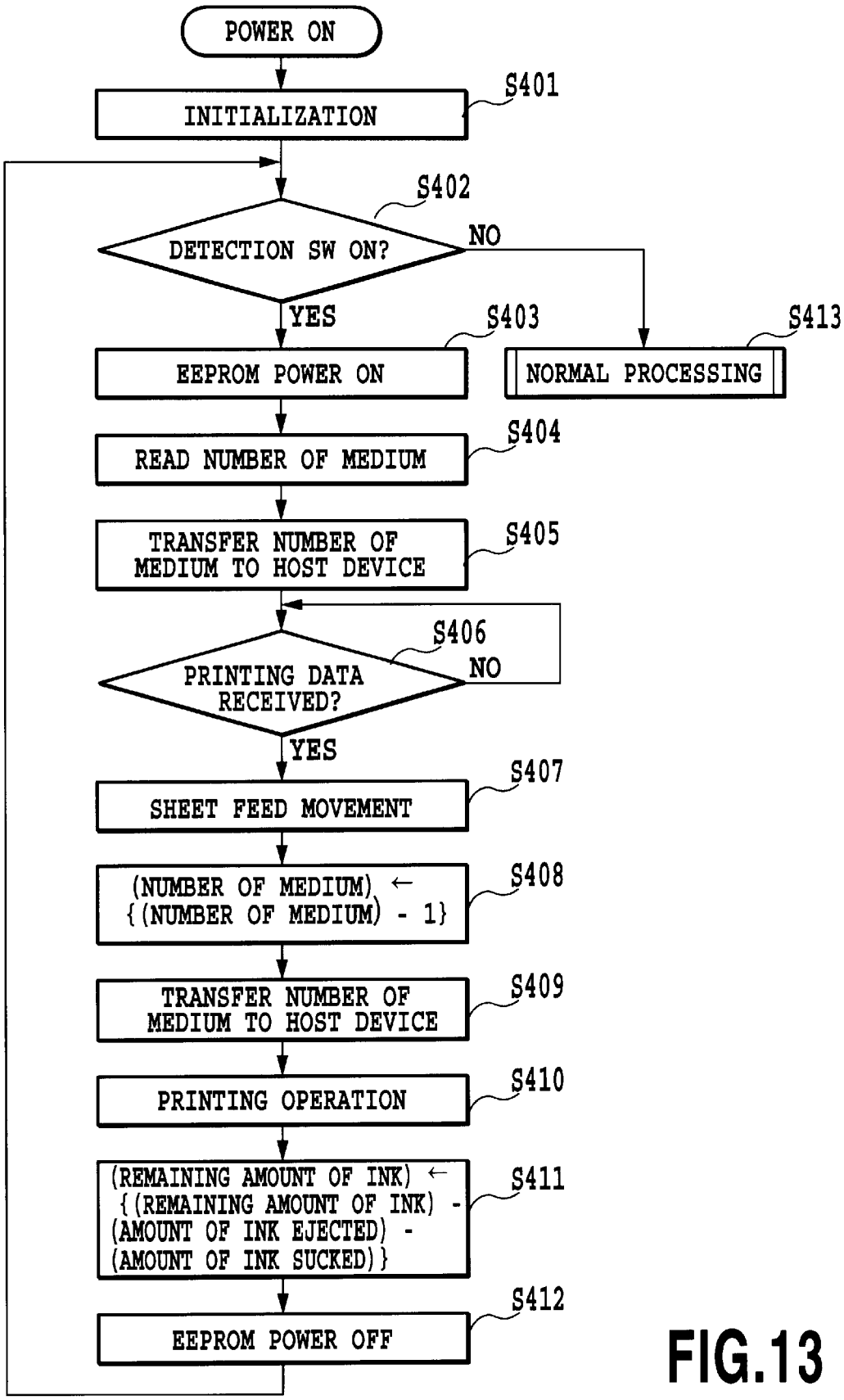
FIG. 13 is a flow chart that illustrates another example of the process performed during the standby of printing movement of FIG. 12.

FIG. 13 is a flow chart showing an example of another control provided by the MPU 301.

In FIG. 13, after the ink-jet printer has been powered up, the MPU 301 initializes the apparatus at step S401. Next, at step S402, the state of the installation detecting switch 315 for the ink media pack 20 is read via the I/O port 305. At this time, if the switch 315 is active, then it is determined that the ink media pack 20 is installed. At step S403, the power is supplied to the EEPROM 402 to read the number of remaining printing medium stored in the EEPROM 402 (step S404). At step S405, the read data are transferred to the host equipment 300 via the above mentioned transmission and reception means 304 such as an centronics interface.

A status monitor of the host equipment displays the current number of remaining printing medium housed in the ink media pack 20 on the monitor. Then, when it is determined at step S406 that the printing data have been received from the host equipment, the printing medium in the ink media pack 20 are fed at step S407. Then, at step S408, the data on new value equal to the number of currently remaining printing medium minus one is written to the EEPROM 402 and transferred to the host equipment 300. The number of remaining printing medium displayed on the monitor is changed (S409) and the printing operation is performed at step S410. Once printing has been completed for one sheet, then at step S411, the data on value of the amount of remaining ink is read from the EEPROM 402 for each color.

Then, the amount of ink ejected for the printing for this sheet and the amount of preliminary ejection are subtracted from the read value or the amount of sucked ink is subtracted from the read value if a suction operation has been performed, and the data on the result is written to the EEPROM 402. Subsequently, at step S412, assuming that the ink media pack 20 is to be removed, the process shifts to step S402 to repeat the above mentioned process. Precisely speaking, the amount of ink remaining in the ink housing section is calculated based on the amount of ink supplied from the ink housing section to the sub tank in the carriage. Since, however, a small amount of ink is housed in the sub tank and the ink is thus frequently supplied from the ink housing section to the sub tank, the amount of ink ejected for printing, the amount of ink for preliminary ejection, and the like can be directly used to calculate the amount of ink remaining in the ink housing section.

The above process enables the current number of printing media in the ink media pack 20 to be determined so that this data can be transmitted to the host equipment 300, where it can be displayed on a CRT of the host equipment 300, thereby improving the user interface. Additionally, the latest state of the interior of the ink media pack 20 can always be determined so that this information can be read and used for a process of determining the amount of inks injected for recycling or other processes.

Next, an ink replacing system and an ink supplying method included in this embodiment will be described.

The ink replacing system of this embodiment supplies the ink from each ink tank housing section of the above described ink media pack, which is an ink source, to the corresponding sub tank mounted in the carriage of the printer apparatus main body. It principally comprises sub tanks, printing heads, ink-air introducing mechanism, and others.

Figure 14:
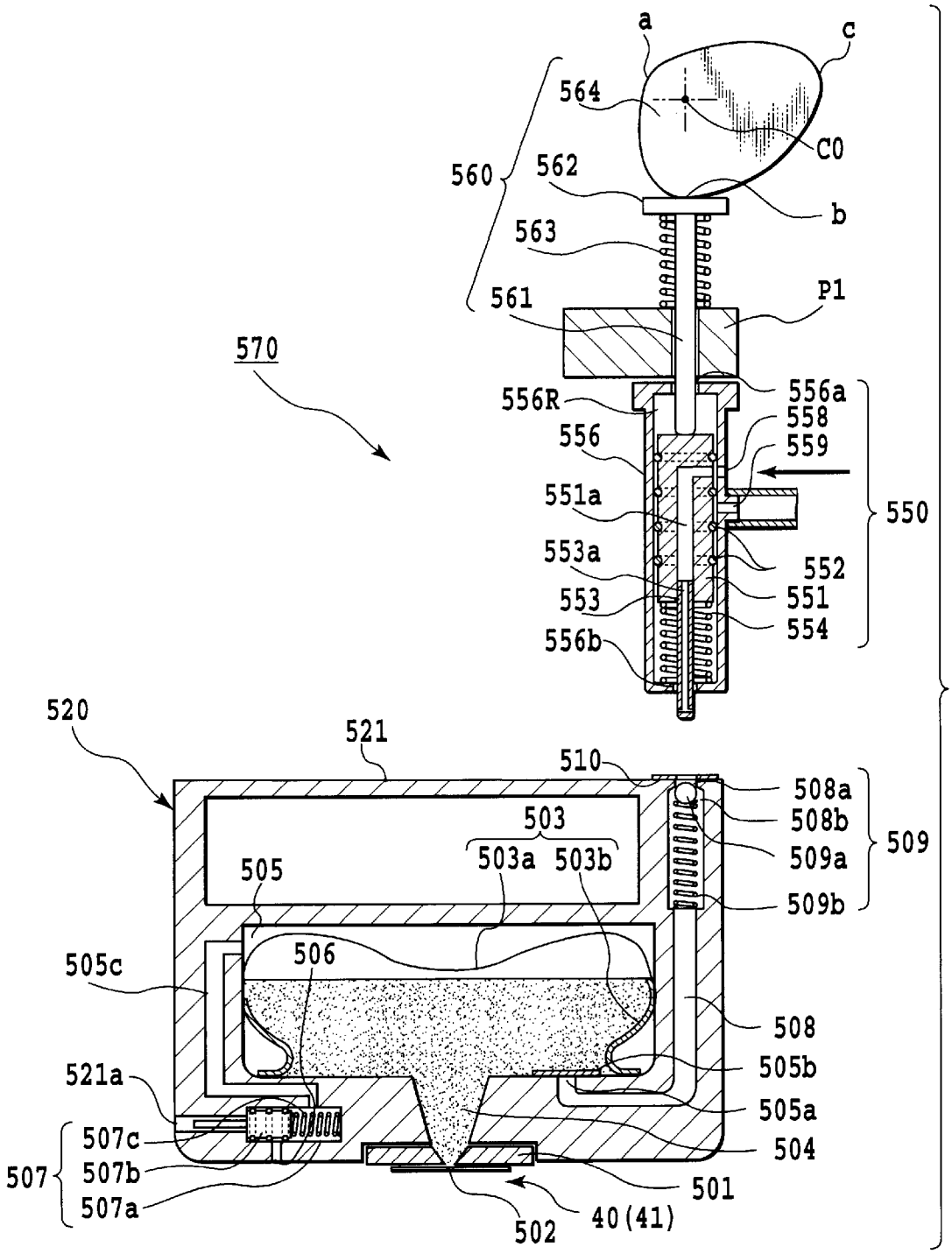
FIG. 14 is a cross sectional view of the vertical sides of the ink sub tank, the printing head, and the ink-air supplying mechanism in the ink-replacement system of the ink-jet printer shown in FIG. 1 in a state of performing the printing movement.
Figure 15:
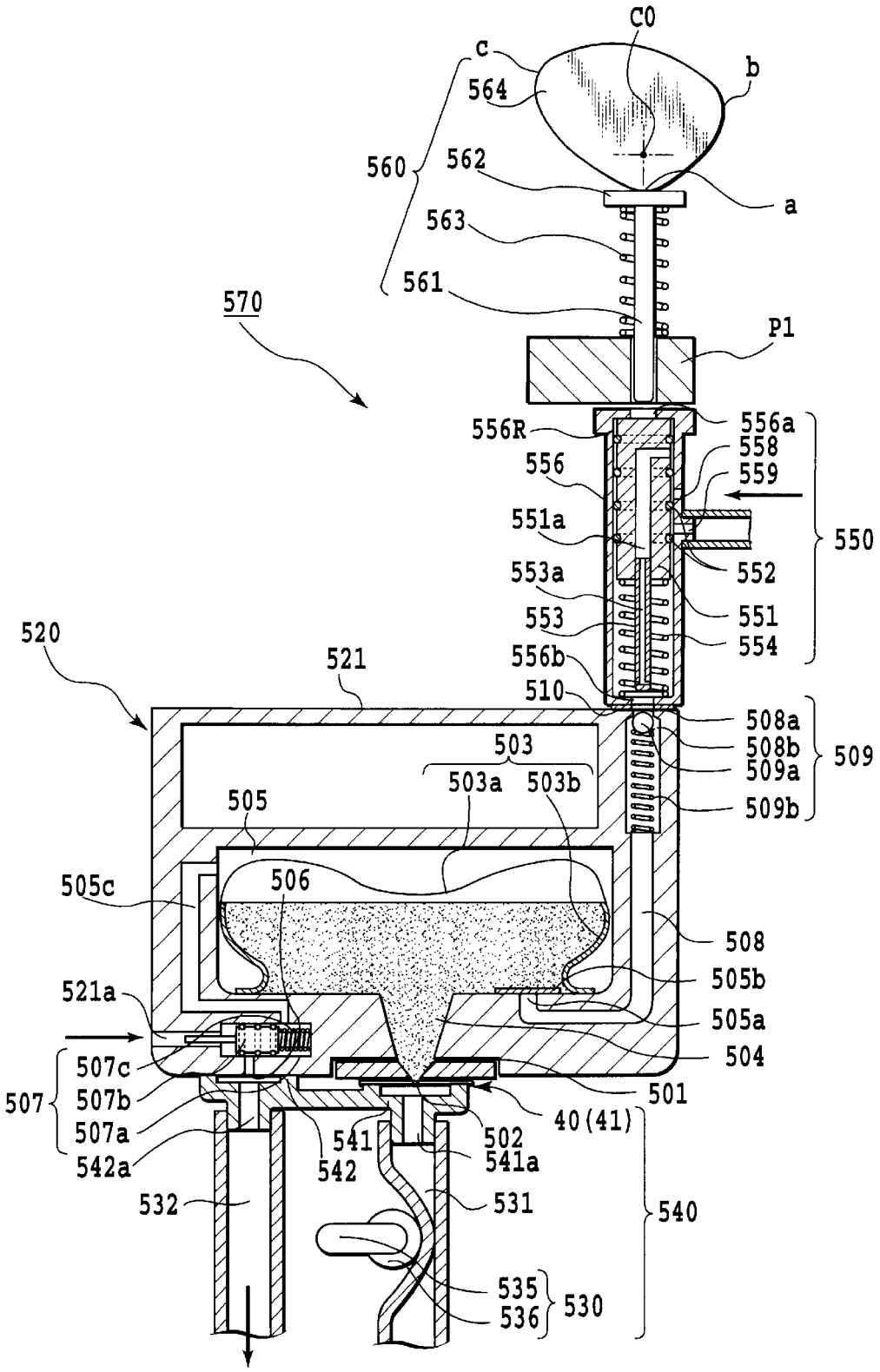
FIG. 15 is a cross sectional view of the vertical sides of the ink sub tank, the printing head, and the ink-air supplying mechanism in the ink-replacement system of the ink-jet printer shown in FIG. 1 in a state of decompressing the sub tank.
Figure 16:
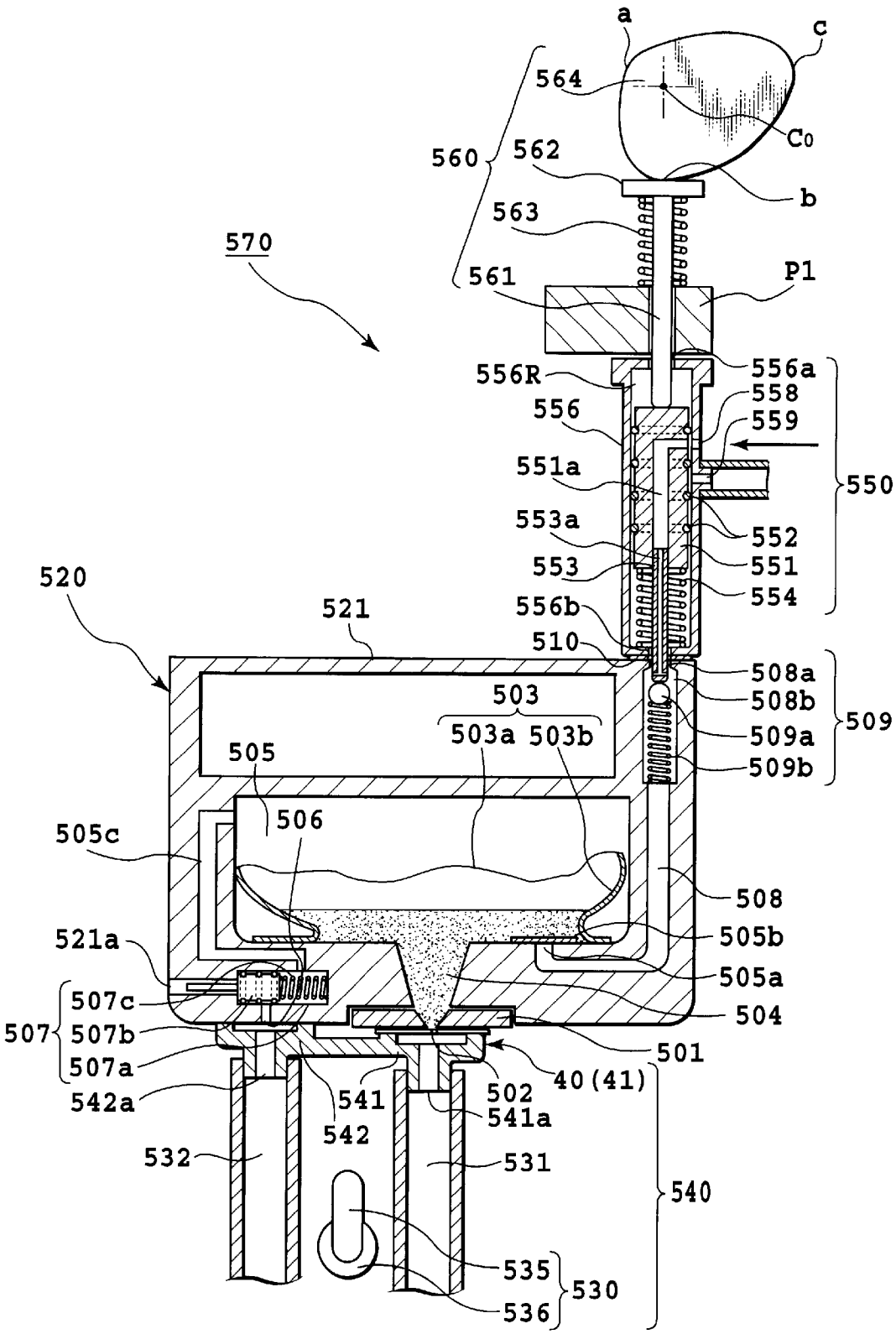
FIG. 16 is a cross sectional view of the vertical sides of the ink sub tank, the printing head, and the ink-air supplying mechanism in the ink-replacement system of the ink-jet printer shown in FIG. 1 in a state of introducing the air into the sub tank.
Figure 17:
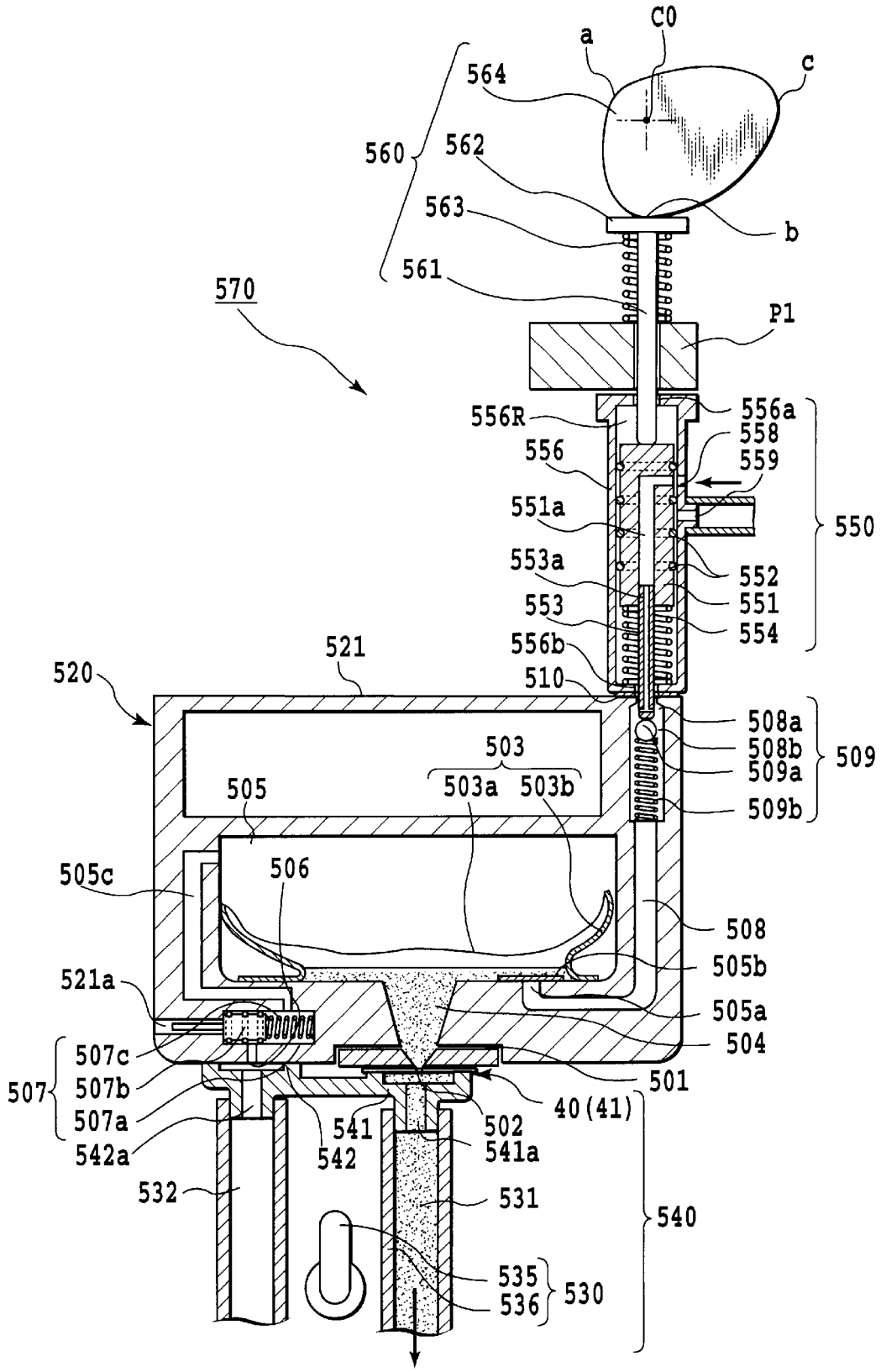
FIG. 17 is a cross sectional view of the vertical sides of the ink sub tank, the printing head, and the ink-air supplying mechanism in the ink-replacement system of the ink-jet printer shown in FIG. 1 in a state of draining the ink and air out of the sub tank.
Figure 18:
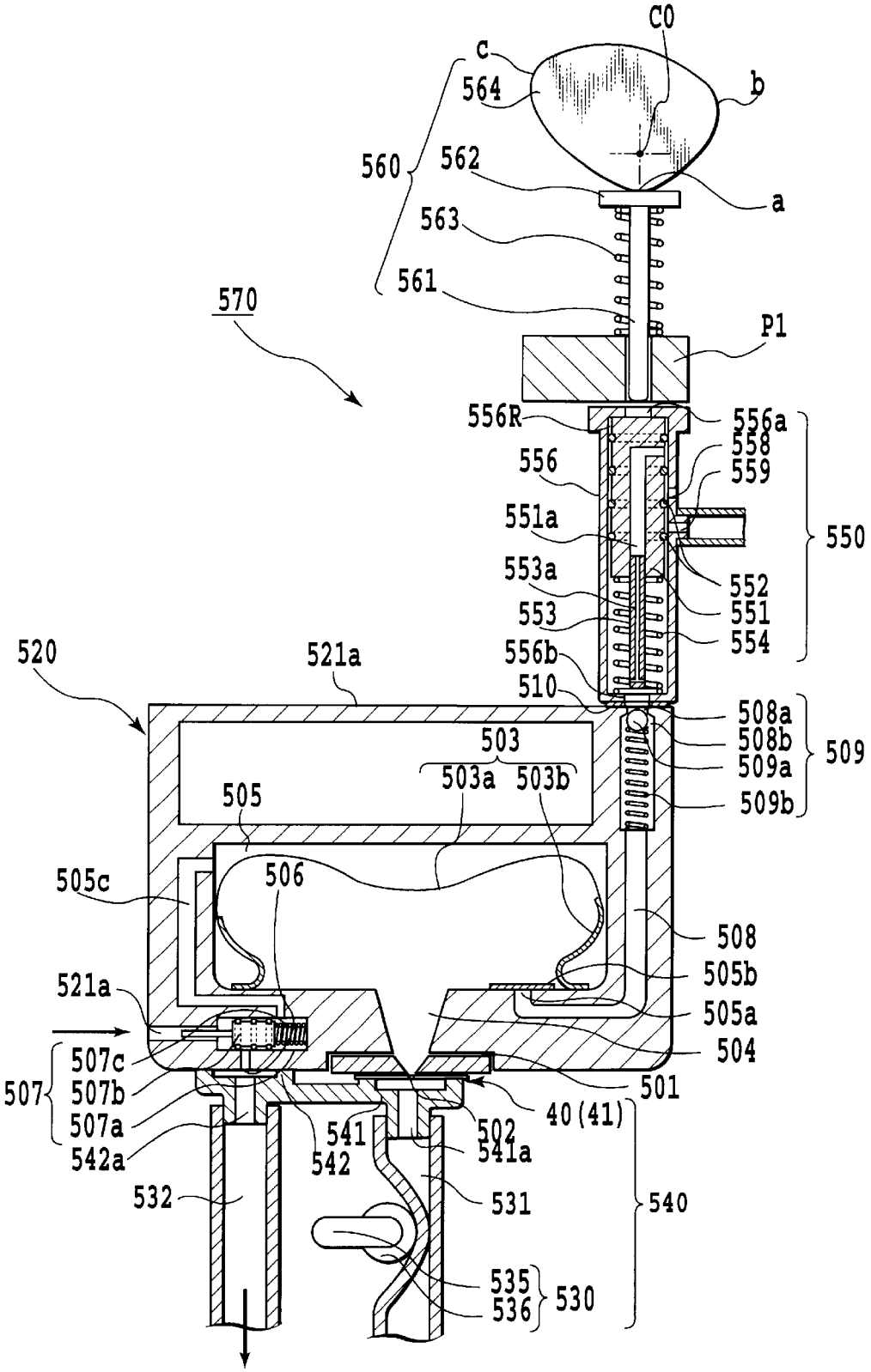
FIG. 18 is a cross sectional view of the vertical sides of the ink sub tank, the printing head, and the ink-air supplying mechanism in the ink-replacement system of the ink-jet printer shown in FIG. 1 in a state of decompressing the sub tank again.
Figure 19:
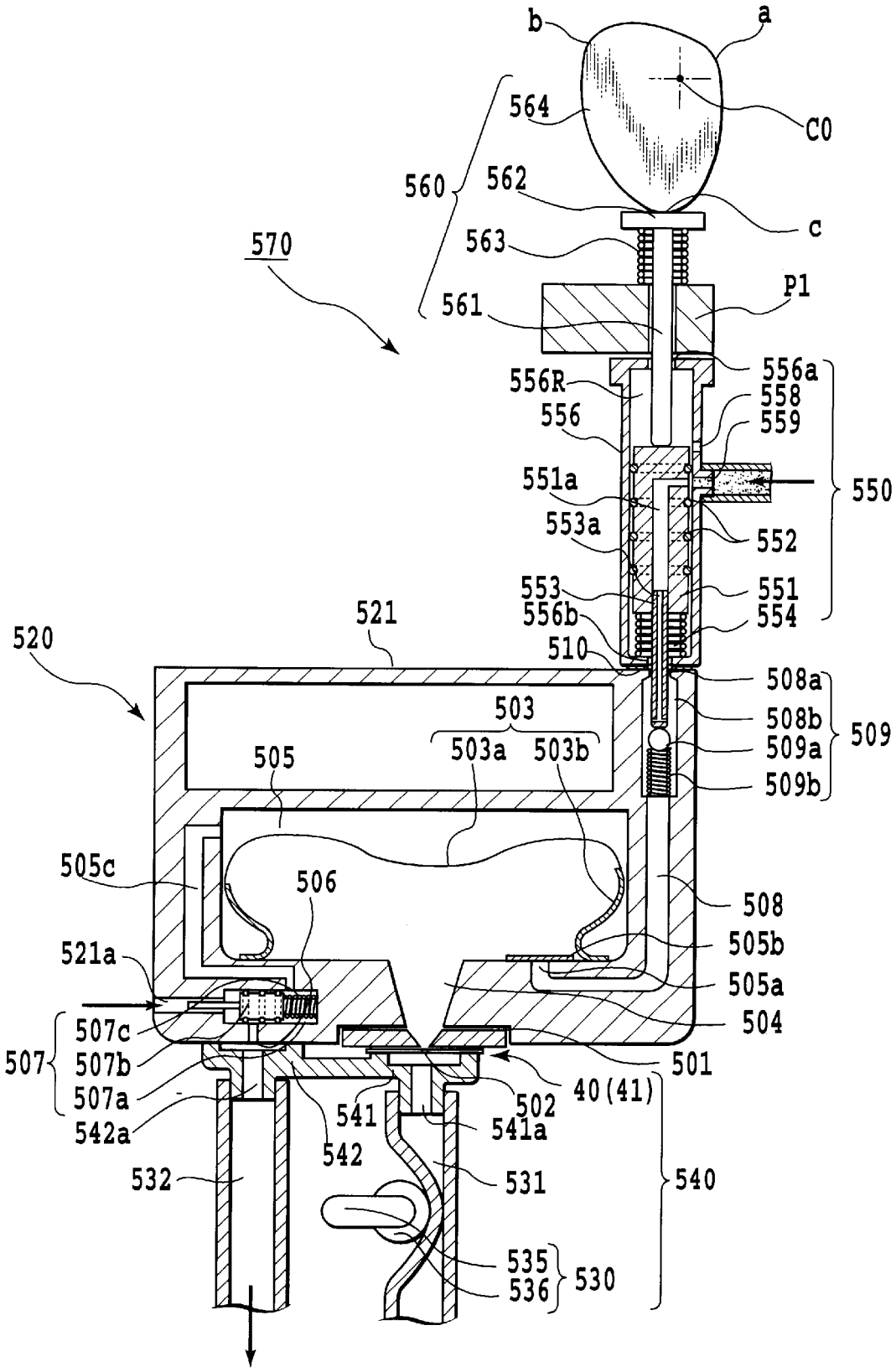
FIG. 19 is a cross sectional view of the vertical sides of the ink sub tank, the printing head, and the ink-air supplying mechanism in the ink-replacement system of the ink-jet printer shown in FIG. 1 in a state of introducing the air into the sub tank.

FIGS. 14 to 19 are a side vertical sectional views showing the sub tank, printing head, and ink-air introducing mechanism of the ink replacing system. FIG. 14 shows how these components operate while the printing operation is being performed, FIG. 15 shows how these components operate when the pressure of the sub tank is reduced, FIG. 16 shows how these components operate while an air is introduced, FIG. 17 shows how these components operate while an ink and air discharging operation is being performed, FIG. 18 shows how these components operate when the pressure of the sub tank is reduced again, and FIG. 19 shows how these components operate when an ink is introduced.

In each figure, reference numeral 501 denotes a printing head having a large number of electrothermal converters or electrostrictive elements (not shown) arranged therein and acting as a source of ink ejecting pressure, and a large number of nozzle sections also arranged therein and each having an ejection port 502 for ejecting an ink. A source of ink ejecting pressure in each nozzle section is connected with a head driving circuit for supplying a printing signal (not shown) and electricity.

Reference numeral 520 denotes a sub tank for storing an ink from the ink housing section 211 formed in the ink media pack and acting as an ink source, the sub tank having the printing head 501 connected integrally with its bottom portion.

In the sub tank 520, reference numeral 521 denotes a sub tank body constituting an outer shell of the sub tank 520 and having decompression chambers 505 identical to applied ink types in number (in this case, four types). The decompression chambers 505 are each connected to an intake passage 505*c* that is in communication with a pressure reduction adjusting port 506 formed at a bottom of the sub tank body 521.

Figure 20:
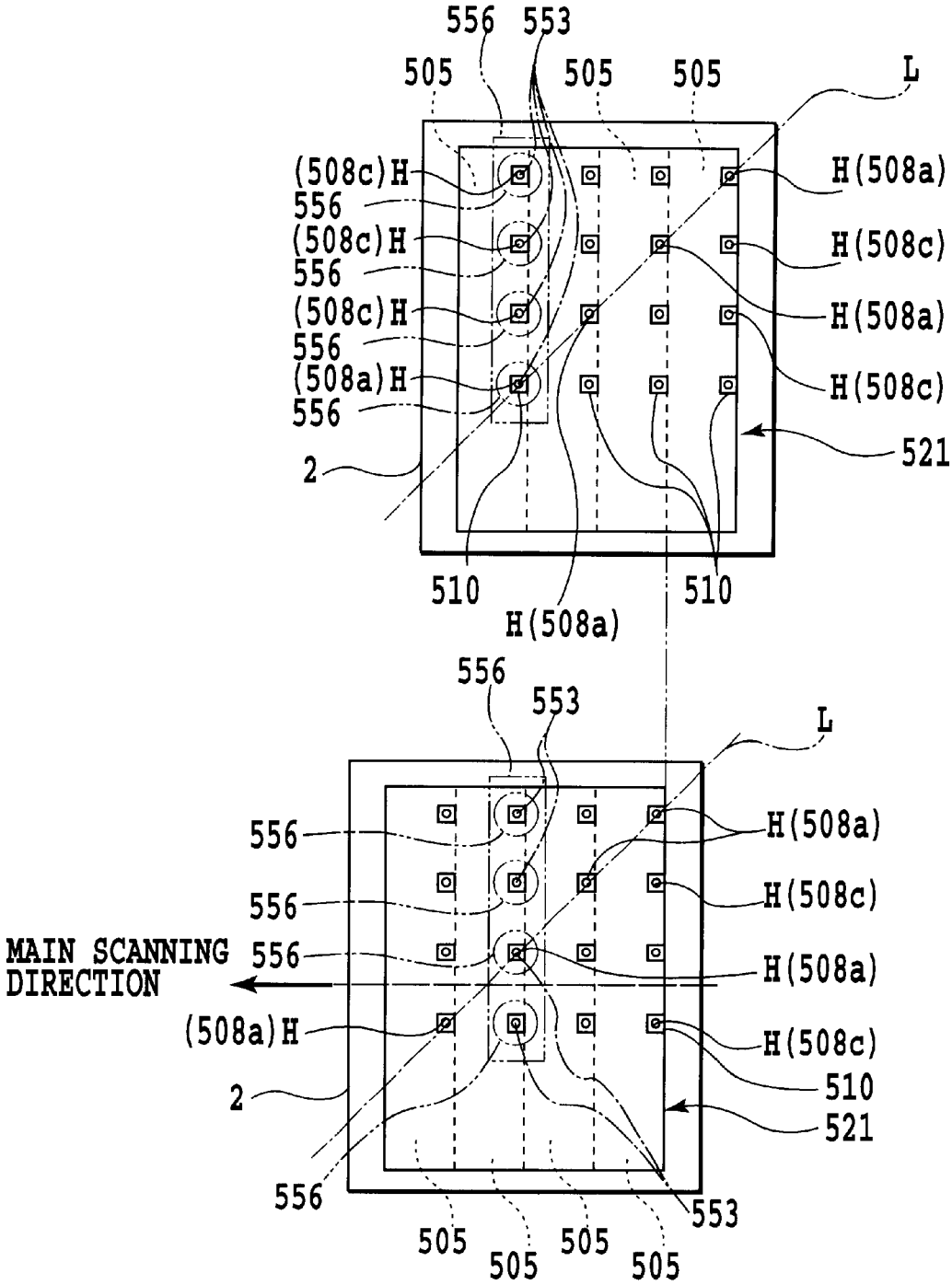
FIG. 20 is a plan view of the sub tanks shown in FIG. 14, illustrating the ink-introducing pores.

Additionally, each sub tank body 521 has four holes H including the above mentioned introduction port 508*a* and formed in a top surface thereof in a line along a vertical direction (that is orthogonal to a main scanning direction) in such a manner as to correspond to one of the decompression chambers 505 as shown in FIG. 20. The entire sub tank has 16 holes H in the form of a matrix. Of these holes, the four introduction ports 508*a* formed in each decompression chamber 505 are arranged on a line crossing the main scanning direction, corresponding to the moving direction of the carriage. On the other hand, the holes H other than the introduction ports 508*a* are an opening of recessed portions 508*c* through which introduction needles 553, described later, are passed and each of which has an elastic ink leakage preventing member (not shown) fixed to a bottom surface of the recessed portion 508*c*.

Further, the introduction passage 508 has a sealing mechanism 509 for sealing the introduction port 508*a* formed in an upper end portion of the passage 508 in such a manner that the port can be opened and closed. The sealing mechanism 509 comprises a ball valve 509*a* housed in a valve housing chamber 508*b* formed in the upstream portion of the introduction passage 508, and a spring 509*b* for urging the ball valve 509*a*. An urging force of the spring 509*b* causes the introduction port 508*a* to be normally sealed with the ball valve 509*a*. Reference numeral 510 denotes an ink leakage preventing member comprising an elastic member and fixed to an outside of the introduction port 508*a*. In addition, reference numeral 505*b* denotes a lead-out valve provided in a lead-out port 505*a* to the introduction passage 508 and which enables inks and air to be lead out to the introduction passage 508, while hindering the inks and air from flowing backwards from the introduction passage 508.

Reference numeral 507 denotes a pressure reduction adjusting mechanism inserted into the intake passage 505*c*. The pressure reduction adjusting mechanism 507 comprises a valve housing chamber 507*a* formed in the suction passage 505*c*, a pressure reduction adjusting valve 507*b* inserted into the valve housing chamber 507*a*, and a spring 507*c* for urging the pressure reduction adjusting valve 507*b*.

The pressure reduction adjusting valve 507*b* normally keep communication between the intake passage 505*c* and the pressure reduction adjusting port 506 shut off by means of the urging force of the spring 507*c*. However, when a predetermined pressurizing member (not shown) is inserted through an insertion hole 521*a* formed in a side surface of the sub tank body 521 and the pressure reduction adjusting valve 507*b* is moved against the urging force of the spring 507*c*, the pressure reduction adjusting port 506 and the intake passage 505*c* communicate with each other via an intake passage (not shown) formed in the pressure reduction adjusting valve 507*b* to reduce the pressure in the decompression chamber 505.

Thus, the pressure reduction adjusting valve 507*b* is shut off from outside air to maintain a reduced pressure therein because the pressure reduction adjusting port 506 is closed except when the degree of pressure reduction is to be adjusted. When the pressure reduced state is thus formed, the ink in the sub tank 505 has its pressure reduced to preclude the ink from dropping, while preventing air from being drawn in through the ejection port 502. Consequently, an appropriate ink meniscus can be formed at the ejection port 502 to quest for stabilizing the ink ejection. The adjusting a degree of pressure reduction can be controlled by providing in the intake passage 505*c* a pressure sensor acting as a pressure reduction measuring means.

Reference numeral 503 denotes an ink liquid chamber housed in the above mentioned decompression chamber 505 and acting as an ink storage section. The ink chamber 503 is shaped like a bag and formed of a flexible member having a lower end portion thereof fixed to a bottom surface portion of the decompression chamber. The ink chamber 503 has its volume varying with a difference between its exterior and interior. In this embodiment, the flexible member comprises a lower half 503*b* formed to be thick and an upper half 503*a* formed to be thin, and the lower half 503*b* is relatively rigid and maintains a constant shape, whereas the upper half 503*a* is not so rigid and has its volume varying depending on a difference between its exterior and interior resulting from the decompression chamber. This configuration serves to reduce the internal volume during the ink discharging operation to lessen the amount of remaining ink. Thus varying the thickness of ink liquid chamber, however, is not essential to the present invention.

In addition, the ink chamber 503 is in communication with the printing head 501 via the ink supplying passage 504 formed at the bottom of the decompression chamber 505 so that the ink from the ink chamber 503 can be supplied to the printing head 501 via the ink supplying passage 504.

Further, reference numeral 540 denotes a pressure reduction applying mechanism (pressure reducing means) provided in the recovery mechanism 42. The pressure reducing mechanism 540 comprises the above mentioned pair of caps 40 and 41, suction pumps (not shown) each provided correspondingly to one of the caps 40 and 41 and acting as a source of pressure reduction, two sets of pressure reducing paths 531 and 532 that each connect the suction pump and the cap together, an ejection port 502 of the printing head 501, and a switching mechanism 530 for switching a pressure reduction applying state of a pressure reduction adjusting port 506. The caps 40 and 41 each comprise an ejection-port-side sealing section 541 that covers and seals the ejection port 532 and a pressure reducing-port-side sealing section 542 that covers and seals the pressure reduction adjusting port 506, as shown in FIGS. 1 and 20. The sealing sections 541 and 542 have suction holes 541*a* and 542*a* formed therein, respectively.

Additionally, the above mentioned two pressure reducing paths 531 and 532 are composed of two tubes 531 and 532 connected to suction holes 541*a* and 542*a* in the sealing sections 541 and 542, respectively, and one 531 of the tubes is formed of a flexible member. Further, the pressure reduction switching mechanism 530 comprises a rotational movement arm 535 positioned between the tubes 531 and 532 by a predetermined drive source and rotationally moved by a predetermined drive means, and a compressible connection roller 536 axially attached to one end of the rotational movement arm 535, wherein selecting the position of compressible connection roller 536 by the rotational movement arm 535 allow selection between a communication state and a shut-off state in the tube 531.

That is, when the compressible connection roller 536 is brought into connect with the tube 531 compressibly as shown in FIGS. 15, 18, and 19, the tube 531 is collapsed to shut off the communication therein to block the ejection-port-side sealing section 541 off from the suction pump. In contrast, when the compressible connection roller 536 is separated from the tube 531 as shown in FIGS. 16 and 17, the tube 531 recovers to its original shape to make the sealing section 541 in communication with the suction pump.

On the other hand, reference numeral 570 denotes an ink-air introducing mechanism. The ink-air introducing mechanism 570 selectively introduces an ink and outside air into the ink chamber 503 in the sub tank 521 to function as an ink introducing mechanism or a gas introducing mechanism. Additionally, the ink-air introducing mechanism has two types of ink-air introducing mechanism: an paper-side one for introducing an ink and air from the above mentioned ink refilling unit 30 and an ink-media-pack-side one for introducing an ink and air from the interior of the ink media pack 20. Both ink-air introducing mechanism have the same structure and comprise a pressurizing mechanism 560 and an introduction switching mechanism 550.

The pressurizing mechanism 560 of the paper-side ink-air introducing mechanism is installed based on a position where the above mentioned paper-ink refilling cap 40, while the pressurizing mechanism 560 of the pack-side ink-air introducing mechanism is installed based on a position where the special-paper-ink refilling cap 41 housed in the ink media pack 20 is disposed. In addition, pressurizing pins 561 of each pressurizing mechanisms 560 are arranged in a line along a direction (subscanning direction) orthogonal to the moving direction (main scanning direction) of the carriage 2.

Further, one of the introduction switching mechanisms 550 is provided in a supply section 30*a* of the paper-ink refilling unit 30, while the other is provided in a supply section 21*a* of the ink media pack 20.

Additionally, the pressurizing mechanism 560 comprises the plurality of (in this case, four) pressurizing pin 561 penetrating a predetermined support P1 on the printer main body in such a manner as to elevate and lower freely, a spring 563 installed with elasticity between a head 562 of each pressurizing pin 561 and the support P1 to normally apply such a urging force that a lower end portion of the pressurizing pin 561 sinks into the support P1, a single eccentric cam 564 rotationally moved around a rotational movement center Co by means of a predetermined drive source. The eccentric cam 564 is provided where it is always connected with the head 562 of each pressurizing pin 561 compressibly, and allow to move rotationally around the rotational movement center Co to move all the pressurizing pins 561 upward and downward.

That is, when a point a (where the distance from the rotational movement center Co is smallest) on a circumferential surface of the eccentric cam 564 comes into contact with the head 562 of the pressurizing pin 561, a lower end portion of the pressurizing pin 561 is set in its initial position where it sinks into the support P1. When a point c (where the distance from the rotational movement center C0 is largest) on the circumferential surface of the eccentric cam 564 comes into contact with the head 562 of the pressurizing pin 561, the lower end portion of the pressurizing pin 561 is set in its maximum projecting position where it projects furthest from a bottom surface of the support P1. Furthermore, when a point b on the circumferential surface of the eccentric cam 564 comes into contact with the head 562, the lower end portion of the pressurizing pin 561 is set in its intermediate position between the initial position and the maximum projecting position.

On the other hand, the introduction switching mechanism 550 comprises an housing 556 having a plurality of (in this embodiment, four) housing chambers 556R partitively formed correspondingly to the pressurizing pins 561, switching blocks 551 each accommodated in the corresponding housing chamber 556R of the housing 556 in such a manner as to become capable of moving up and down, introduction needles 553 each fixed a lower end of the corresponding switching block 551 and having an introduction passage 553*a* formed in a central portion thereof, and springs 554 each elastically installed between the switching block 551 and the bottom of the housing 556.

The housing 556 has a plurality of (in this embodiment, four) insertion holes 556*a* formed in a top surface thereof in such a manner as to correspond to the pressurizing pins 561 of the above described pressurizing mechanism and into and from which the corresponding pressurizing pin 561 can be inserted and removed, and has a plurality of (in this embodiment, four) insertion holes 556*b* formed in a bottom surface thereof in such a manner as to correspond to the introduction needles 553, which the introduction needles 553 can be inserted and removed. Furthermore, each housing chamber 556R of the housing 556 has an air introducing port 558 and an ink introducing port 559 formed in a side surface thereof. The air introducing port 558 is in communication with outside air, and the ink introducing port 559 is connected via a predetermined communication passage to the paper-ink refilling unit 30, which is a source of inks, or the ink housing section 211 of the ink media pack 20.

Additionally, the switching blocks 551 can each be elevated and lowered through the corresponding housing chamber 556R of the housing 556 by means of an O ring 552 fixed to a circumferential surface of the switching block, while maintaining a gas-tight contact with an inner surface of the housing chamber 556R. The switching block 551 has an introduction passage 551*a* bent in the form of the character L in a fashion leading from a side opening formed in one side surface of the passage to a bottom opening formed in the center of a bottom portion of the passage; the introduction passage 551*a* is in communication with the introduction passage 553*a* in the above mentioned introduction needle 553.

Moreover, the introduction needles 553 are arranged in the sub scanning direction similarly to the pressurizing pins 561 of each pressurizing mechanism 560. Accordingly, the introduction ports 508*a* are arranged in a direction crossing the arranging direction of the introduction needles 553 within the housing 556 as shown in FIG. 20. A disposing pitch for the introduction ports 508*a* in the sub scanning direction, however, is set the same as that for the introduction needles so that the carriage 2 can be moved in the main scanning direction to sequentially align on a one by one basis among four pieces of the introduction needles 553 with the corresponding introduction ports 508*a* as shown in FIG. 20. This introduction switching mechanism constitutes an ink introduction switching means and a gas introduction switching means.

Next, an ink replacing operation and an ink supplying operation according to this embodiment will be explained.

As described previously, this embodiment performs switching of the printing operation between the one with special paper from the ink media pack 20 or the like and the one with ordinary paper from the same, a change in the type of the media pack 20 used, and other operations, so that the types of applied inks must be changed in connection with a change in printing medium, thereby requiring stored inks to be replaced with inks to be used for the next printing operation.

This ink replacement is carried out as shown in FIGS. 14 to 19. Description will be made by taking by way of example an operation executed to replace the inks in connection with a change in the type of the ink media pack 20.

When a replacement command is input to replace the ink media pack, the carriage 2 with the sub tank 520 mounted therein moves to a receding position at a side of the apparatus where it can avoid interfering with the ink media pack 20(see FIG. 1). Then, the ink media pack 20 being used is removed.

Subsequently, a new ink media pack 20 is installed and the pressurizing mechanism 560 is moved from the receding position to an installation position at a lateral side of the apparatus. Then, the bottom portion of the housing 556 in the introduction switching mechanism 550 is located close to the top surface of the sub tank body 521, and the pressurizing pins 561 of the pressurizing mechanisms 560 are opposed to the corresponding insertion holes 556*a* formed in the top surface of the housing 556.

Then, the information on the ink stored in each ink chamber 503 is read out from the memory 400 for the newly installed ink media pack 20, and when the ink replacing command is input, the MPU determines which inks must be replaced based on the current ink information and the information on the ink used last.

Based on this determination, the carriage 2 moves to oppose the pressure reduction adjusting port 506 formed in the bottom surface of the decompression chamber 505 storing the ink to be replaced as well as the ejection port 502 in the printing head 501, to the sealing sections 541 and 542, respectively, provided in the cap 40 or 41. Subsequently, the cap 40 or 41 elevates to bring the sealing sections 541 and 542 into tight contact with peripheries of the ejection port 502 and the pressure reduction adjusting port 506 (see FIG. 15).

Thereafter, the rotational movement arm 535 of the pressure reduction switching mechanism 530 rotates to bring the compressible connection roller 536 into connection with the tube 531 compressibly to thereby shut off the communication between the ejection port 502 and the suction pump. On the other hand, the pressure reduction switching valve 507*b* is pushed in by a push-in member (not shown) against the urging force of the spring 507*c* and the decompression chamber 505 is allowed to communicate with the suction pump via the pressure reduction adjusting valve 507*b* or the like. In this case, since the introduction passage 508, which can communicate with the decompression chamber 505, is shut off from outside air by the sealing mechanism 509, the interior of the decompression chamber 505 has its pressure reduced by means of an air sucking operation of the suction pump. In addition, the upper half 503*a* of the ink chamber 503 housed in the decompression chamber 505 is formed of a flexible member, so that when the pressure in the decompression chamber 505 is reduced than the atmosphere, the ink chamber 503 has its volume changed correspondingly to have its pressure reduced.

Then, when the decompression chamber 505 reaches a fixed degree of pressure reduction, the pressurizing member (not shown) cancels the pressure on the pressure reduction adjusting valve 507*b*, which thus returns to its initial position due to the urging force of the spring 507*c* to shut off the communication between the intake passage 505*c* and the suction pump to thereby maintain a state of the reduced pressure in the decompression chamber 505 and in the ink chamber 503 (see FIG. 15).

Then, the eccentric cam 564 is rotated around the rotational movement center Co by the drive means (not shown) and then stopped where its circumferential point b comes into contact with the head 562. This causes the pressurizing pin 561 to project from the bottom surface of the support P1 and pass through the insertion hole 556*a* into the housing 556 to push the switching block 551 downward, so that the air introducing port (gas introducing port) 558 and the introduction passage 551*a* communicate with each other (see FIG. 16). As a result, outside air is introduced into the ink chamber 503, having its pressure reduced, from the air introducing port 558 through the introduction passages 551*a*, 553*a*, and 508 and the introduction valve 505*b*. This pressure reduction and air introduction causes the ink to be rolled and agitated inside the ink chamber 503 to allow the ink to flow more smoothly.

Then, the suction pump, acting as a source of suction, is activated to discharge the ink used for the last printing operation and remaining in the ink chamber 503, from the ejection port 502 via the tube 531 (see FIG. 17). This discharge step enables the ink in the ink chamber 503 to be completely discharged, but for more reliable discharge, it is also effective to repeat the above described pressure reducing, air introducing, and discharge steps or reciprocate the carriage 2*a* predetermined distance to roll the internal ink.

After the ink has completely been discharged, the eccentric cam 564 is rotated to bring its circumferential point a into the head 562, as shown in FIG. 18. This causes the pressurizing pin 561 to return to its initial position located above due to the urging force of the spring 563 to exit the housing 556 of the introduction switching mechanism 550. Consequently, the introduction needle 553, with the switching block 551, elevates due to the urging force of the spring 554 to exit the introduction port 508*a*. Thus, the urging force of the spring 509*b* causes the ball valve 509*a* to occlude the introduction port 508*a* to the introduction passage 508 to thereby shut off the communication between the introduction port 508*a* and outside air.

At the same time, the pressure reduction adjusting valve 507*b* of the pressure reduction adjusting mechanism 507 is pressed against the force of the spring 507*c* to allow the intake passage 505*c* and the tube 532 to communicate with each other, thereby allowing the decompression chamber 505 to communicate with the suction pump. On the other hand, the compressible connection roller 536 of the pressure reduction switching mechanism 530 is used to shut off the communication between the ejection port 502 and the suction pump, which is then driven. As a result, the ink chamber 503 has its pressure reduced again.

Then, the pressurizing mechanism 560 is driven to rotate the eccentric cam 564 to bring its circumferential point c into connect with the head 562 compressibly (see FIG. 19). This causes the pressurizing pin 561 to project downward to move the switching block 551 to its maximum projecting position to thereby allow the ink introducing port 559 and the introduction passage 551*a* to communicate with each other. This in turn enables communication through the path from the ink media pack 20, which is a source of inks, to the ink chamber 503, that is, the path from the ink media pack 20 through the ink supplying tube 218*c*, ink introducing port 559, and introduction passages 551*a*, 553*a*, and 508 to ink chamber 503.

In this case, during the pressure reducing step shown in FIG. 18, both the ink chamber 503 and the decompression chamber 505 have their pressures reduced, so that the ink stored in the ink media pack 20 is introduced into the ink chamber 503 via the above mentioned path. Once the ink chamber 503 then is filled with the ink, the eccentric cam 564 is rotated to remove the pressurizing pin 561 from the housing 556 to remove the introduction needle 553 from the introduction port 508*a* to thereby complete the ink introducing step, thereby completing the ink replacing step for the one ink housing chamber. In this regard, the operation during the ink introducing step is identical to the operation executed to supply the ink, which has been consumed by the printing or recovery operation.

In addition, after the introduction needle 553 has been removed after the ink filling as in FIG. 18, the degree of pressure reduction may further be adjusted in order to make the pressure in the sub tank 520 suitable for the printing operation.

After the ink chamber 503 in one of the decompression chambers 505 in the sub tank 520 has been supplied with the ink as described, if another ink chamber 503 must be supplied with the ink, the cap 40 or 41 first lowers to separate from the bottom surface of the sub tank 505, and the above described elevating and lowering mechanism then lowers the carriage 2 with the sub tank to separate from the enclosure 565. Subsequently, the carriage 2 moves in the main scanning direction to oppose the pressure reduction adjusting port 506 and ejection port 502 in the another pressure reduction chamber 505 to the cap 40 or 41. Then, the cap 40 or 41 elevates again to seal the pressure reduction adjusting port 506 and the ejection port 502, and then the pressure reducing, air introducing, discharge, pressure reducing, ink introducing, and other steps are subsequently sequentially executed as described above. The above operation is repeated for each decompression chamber 505 for which the ink must be replaced.

The four pressurizing mechanisms 560 provided in this embodiment are structured so that the single eccentric cam 564 simultaneously elevates and lowers equal parts all the pressurizing pins 561. Thus, all the switching blocks 551 and introduction needles 553 of the introduction switching mechanism 550 are simultaneously pressed in response to the pressurizing operation of the pressurizing pins 561.

As described above, however, an array of the introduction ports 508*a* is directed to the direction intersecting the sub-scanning direction that corresponds to the direction along an array of the introduction needles 553, so that only one needle 553 is brought into contact with one of the introduction ports 508*a*. The remained needles 553 are respectively inserted into three recessed portions 508*c* being arranged in a line among twelve recessed portions 508*c* formed on the top surface (on which introduction orifices are formed) of the sub tank body 521. In this embodiment, a plurality of the introduction ports 508*a* does not receive the corresponding introduction needles 553 at the same time. The introduction of ink is individually performed on the introduction ports 508*a* one at a time.

Therefore, the ink chamber 503 that requires the replenishment of ink can be refilled with ink or replaced with the new one, when the remained amounts of ink in the ink chambers 503 in the sub tank 502 are varied and only one of the ink chambers 503 requires the replenishment of its specific ink. As a result, a desired amount of specific ink can be effectively introduced in the target ink chamber 503.

In addition, an ink-leakage preventing member having an appropriate elasticity is provided on the bottom of the recessed portion 508*c*. The lower end of the introduction needle 553 inserted in the recessed portion 508*c* presses the ink-leakage preventing member. Thus, an undesired ink leakage can be prevented without causing any damage on the tip of the introduction needle 553. In addition, the remained introduction ports 508*a*, in which the introduction needles are not inserted, are being plugged by ball valves 509, respectively, so that dusts or the like cannot be entered into the induction passages 508.

FIG. 20 is a top view of an example of the sub tank body 521 on which the present invention is applied. As shown in the figure, a plurality of introduction ports 508*a* and a plurality of recessed portions 508*c* are arranged as an 4 by 4 matrix. In this example, in fact, four different color inks are used for the printing, so that they are arranged as the 4 by 4 matrix. In this example, furthermore, the introduction ports 508*a* are located at the positions on a diagonal line L of the matrix in a slanted direction with respect to the main scanning direction. The recessed portions 508*c* are located at other positions on the matrix. The recessed portions 508*c* are formed for the purpose of protecting the corresponding introduction needles 553 which are not devoted to the ink supply, as described later. On the other hand, the introduction needles 553 provided on the housing 556 on the side of the ink tank that reserves ink are arranged in the direction perpendicular to the scanning direction (i.e., they are vertically arranged in FIG. 20). In this example, furthermore, there are four introduction needles 553 for the supply of four different color inks.

As the introduction needles 533 on the side of supplying ink and the introduction ports 508*a* on the side of receiving ink are arranged as described above, the introduction needles 553 can be coupled to the corresponding introduction ports 508*a* by means of the eccentric cam 564 which are described above with reference of FIG. 14 and so on. That is, four introduction needles 553 are concurrently driven by a single driving source and move toward the introduction ports 508*a*. As shown in the upper portion of FIG. 20, for example, only the introduction needle 553 located on the lowest end can be brought into connect with one of the introduction ports 508*a* located on the lowest part of the most left line. Three remained introduction needles 553 are located at positions facing to recessed portions (i.e., dummy introduction pores) 508*c* which do not communicate with ink sub tanks. Thus, the remained needles 553 are protected by the recessed portions 508*c* instead of supplying ink into the ink sub tanks. If the ink supply is required by another introduction port 508*a*, the sub tank body 521 is shifted its position. If the ink is supplied to the introduction port 508*a* located on the second line from the left and the second from the underside, as shown in the lower part of the FIG. 20, for example, the sub tank is moved so as to connect the introduction needle 553 located on the second from the underside with that introduction port 508*a*. Three remained introduction needles 553 are inserted in the recessed portions 508*c* to protect the tips thereof without performing their ink-supplying operations. Subsequently, for example, the ink supply to the other introduction ports 508*a* may be performed by moving the sub tank body 521 in succession.

In the above example, the introduction needles on the side of supplying ink are arranged in a line perpendicular to the main scanning direction, and also the introduction pores on the side of the sub tank body are arranged in the direction diagonal to the main scanning direction. According to the present invention, however, their arrangements are not limited to. The introduction needles on the side of supplying ink may be arranged in the direction diagonal to the main scanning direction, and also the introduction pores on the side of the sub tank body may be arranged in a line perpendicular to the main scanning direction. Furthermore, various arrangements are possible as far as ink can be supplied to the predetermined introduction pore.

In the above description, the example using four different color inks has been illustrated. According to the present invention, any combination of different ink colors, for example three or less different color inks or five or more different color inks, may be available if the introduction pores are designed so that they cannot receive ink except one that requires replenishing.

[Second Embodiment]

Figure 21:
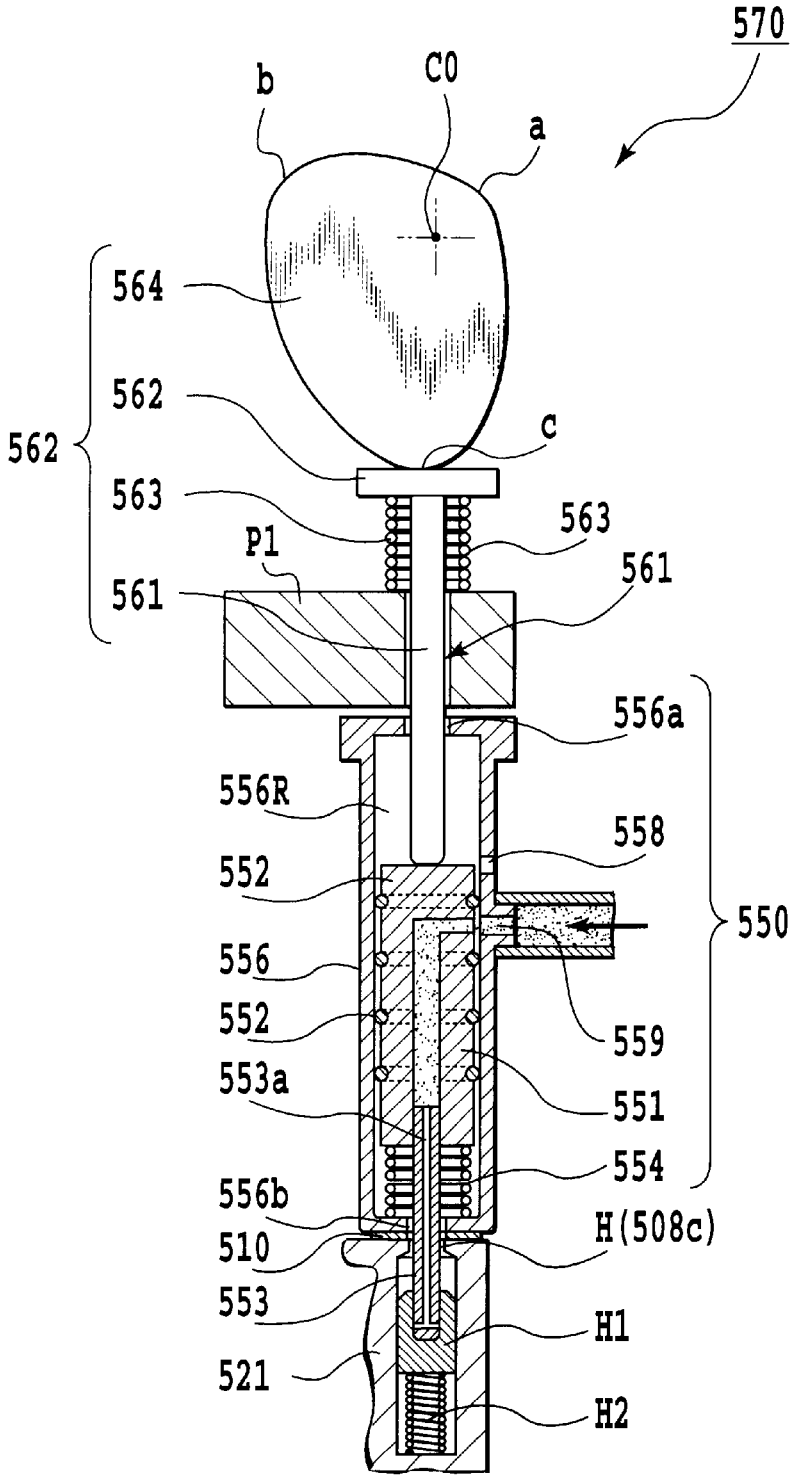
FIG. 21 is a cross sectional view of the vertical side of the ink-air supplying mechanism and the structure of concave portion in accordance with second embodiment of the present invention.
Figure 22:
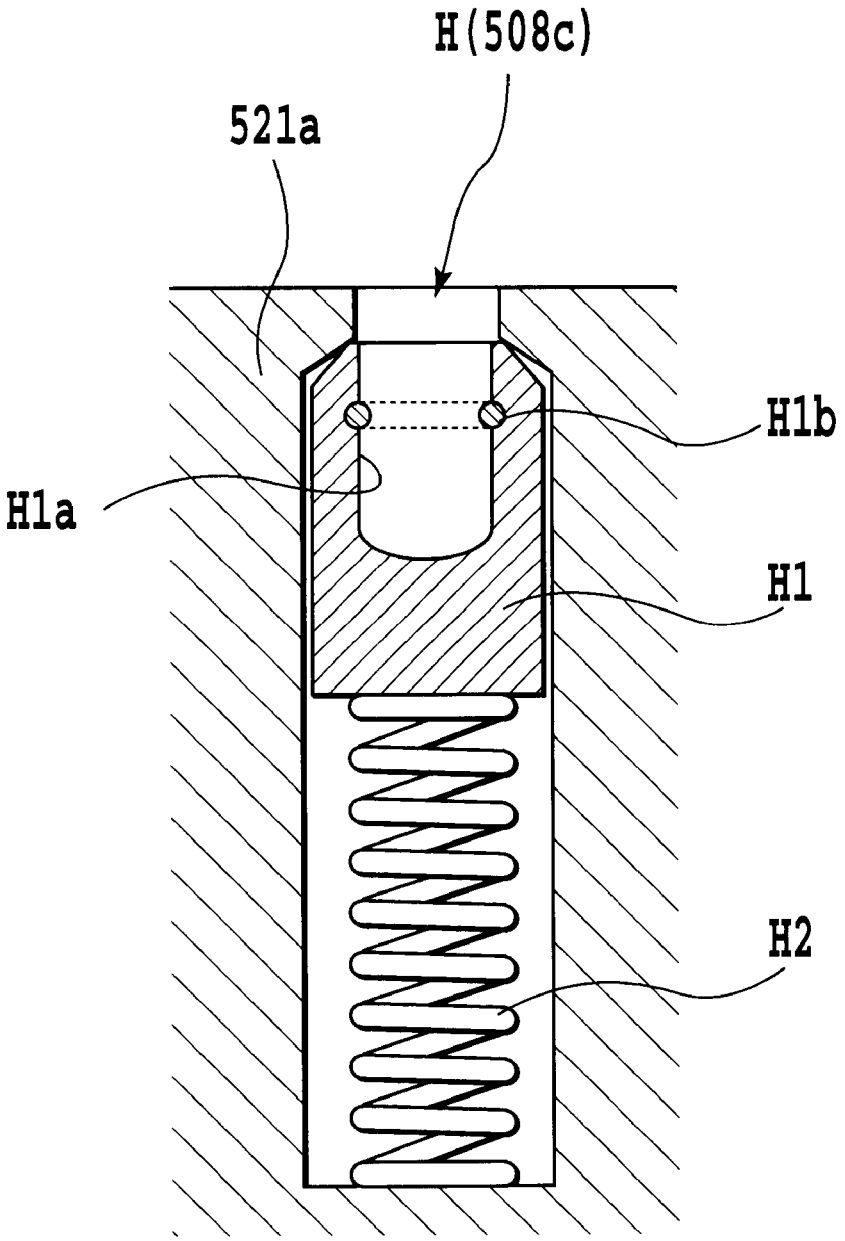
FIG. 22 is an enlarged cross sectional view of the vertical side of the concave portion.

In the first embodiment, as described above, the recessed portion 508*c* is designed so that the leakage preventing member having its own elasticity is placed on the bottom of the recessed portion 508*c*. As shown in FIGS. 21 and 22, however, the following alternative construction may be available.

In FIG. 21 and FIG. 22, a recessed portion H(508*c*) is formed on a flat top surface (on which introduction pores are formed) of a sub tank body 521. A spring H2 is placed in the recessed portion H(508*c*) so that the lower end of the spring H2 is fixed on the bottom of the recessed portion H(508*c*) and the upper end thereof has a sealing member H1 with a small elasticity. Generally, the upper end of the sealing member H1 is pressed against the opening edge of recessed portion H by an elastic force of the spring H2, so that it tightly fits into the recessed portion H in an irreversible manner. In addition, a fit groove H1*a* is formed the recessed portion H in the radial direction for fitting the end portion of the introduction needle 553 in the recessed portion H. As shown in the figure, an O-shaped ring H1*b* is fixed in the inner surface of the fit groove H1*a* to insure a tight fit between the needle 553 and the recessed portion H.

According to the recessed portion 508*c* having the internal structure described above, the inner peripheral surface of the recessed portion H1 covers an outlet formed in the tip of the introduction needle 553 with reliability, and also the O-shaped ring seals the upper side of the outlet to interrupt a communication with outside air. Therefore, ink remained in the introduction needle 553 can be perfectly protected from leakage. In addition, the introduction needle 553 and the sealing member H1 are kept in contact with each other at a constant pressure by an elastic force of the spring H2, while a pressure applied in the direction of inserting the introduction needle 553 can be absorbed by a contraction of the spring H2. Therefore, the introduction needle 553 can be perfectly protected from damage.

By the way, the directions of arranging the introduction needles 553 and the introduction ports 508*a* may be respectively along straight lines crossing each other, regardless of the sub-scanning direction. Alternatively, these directions may be respectively along curved lines. It may be essential only that if a pair of the introduction needle (ink-supplying portion) and the introduction pore (ink-receiving portion) is brought into a communicating state by moving the carriage in the main-scanning direction each of the other pairs is brought into a closed state. If a plurality of induction needles A1, A2, A3, and A4 and a plurality of induction pores B1, B2, B3, and B4 are used and make pairs of A1 and B1, A2 and B2, A3 and B3, and A4 and B4, one of the pairs, for example A1 and B1 are brought into communicate with each other while the other combinations are brought into closed states, respectively. In this case, if the carriage moves forward or backward in the main-scanning direction over the distance covered by the carriage for communicating the induction needle with the induction pore in each of the pairs one by one, the distance (L1) between A1 and B1, the distance (L2) between A2 and B2, the distance (L3) between A3 and B3, and the distance (L4) between A4 and B4 are different from each other ($L1 \neq L2 \neq L3 \neq L4$). In addition, the induction needle and the induction pore in each of the pairs, A1 and B1, A2 and B2, A3 and B3, and A4 and B4 are located on the same positions in the sub-scanning direction, respectively.

In this embodiment, the introduction passages 551*a*, 553*a*, and 508 are provided as common passages, respectively, where both ink and air flow. Alternatively, the induction passage may be independently divided into an air passage and an ink passage.

In this embodiment, furthermore, ink in the ink chamber is drained by ejecting ink droplets from the ejection ports of the printing head 501. Alternatively, ink in the ink chamber may be drained through an ink-discharge passage having a comparatively large flow area, which is formed as a different component with respect to the ejection port of the printing head 501. This configuration allows to prevent the ejection ports from the decreases in their lives in addition to promptly drain ink from the passage.

[Third Embodiment]

In the present embodiment, RAM 303 in FIG. 11 reserves areas for storing ink information that indicates the type of ink used in the immediately preceding printing movement and ink information that indicates the type of ink to be used in the next printing movement. The ink information to be used in the next printing movement is one read out of a memory in the pack when the pack is loaded or one read out of a memory of the printer when the pack is unloaded. The ink information may be distinguished in every tank portion for holding ink and then stored in the memory. The information allows that the useless displacement of the same ink can be prevented before and after the insertion or withdrawal of the pack.

Figures 23, 23A:
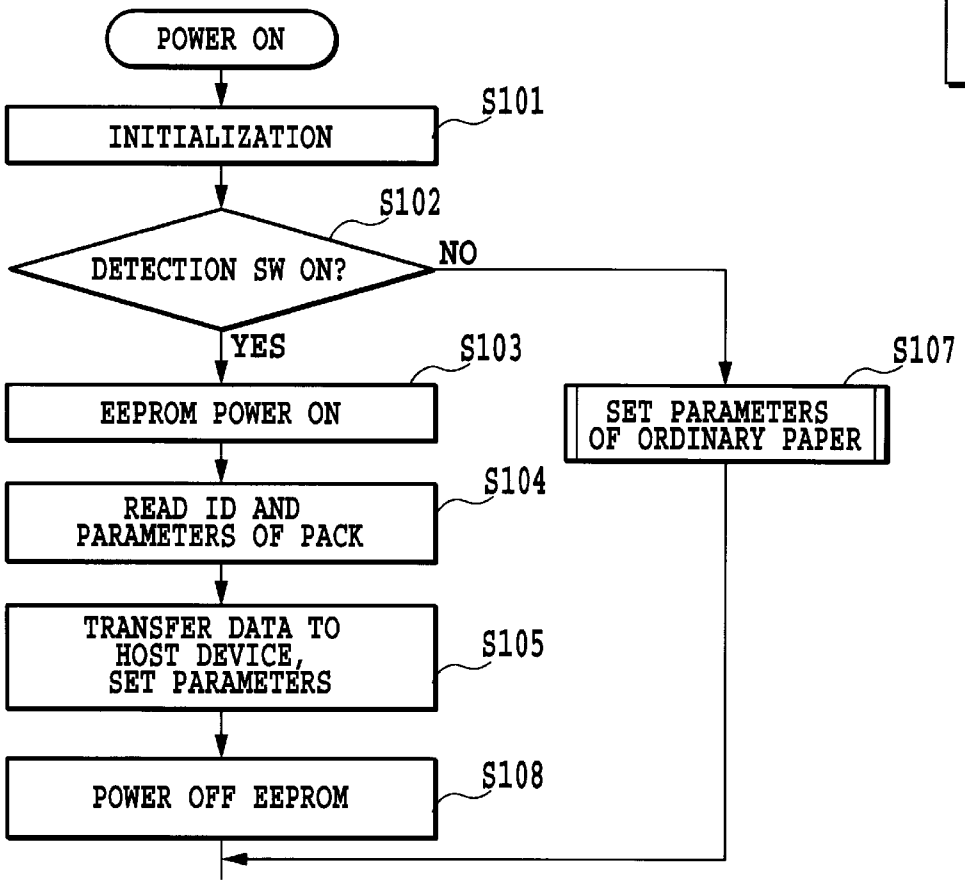
FIG. 23 is a diagram the relationship of FIG. 23A and 23B.
FIG. 23A is a flow chart of the procedure for controlling the ink-jet printer in accordance with the third embodiment of the present invention.
Figure 23B:
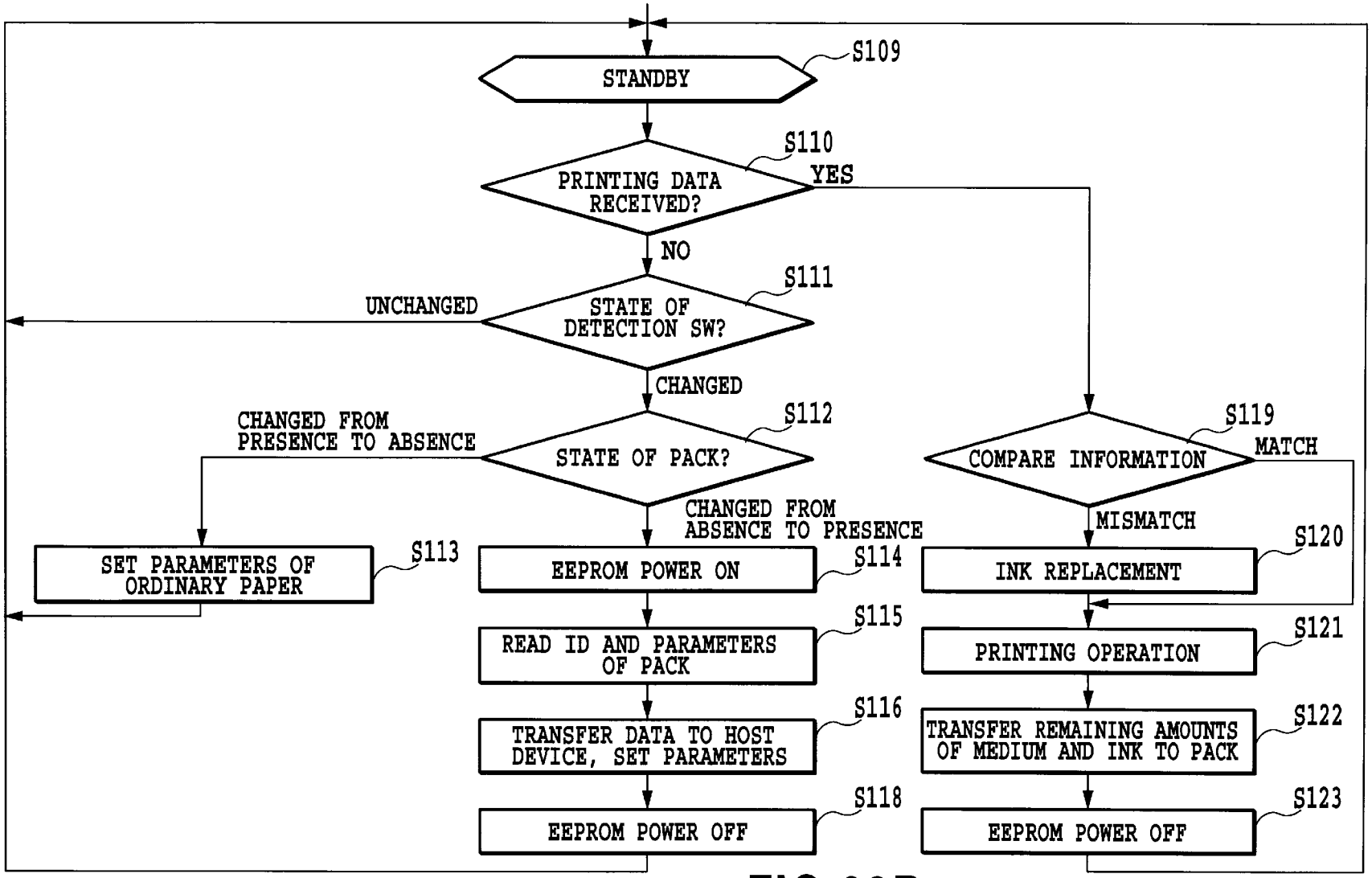
FIG. 23B is a flow chart of the procedure for controlling the ink-jet printer in accordance with the third embodiment of the present invention.

FIGS. 23A and 23B are flow charts that illustrate the control procedure for the ink-jet printer of the present embodiment.

After powering the ink-jet printer ON, MPU 301 performs a default setting (S101). Next, the state of switch 315 for detecting the pack placement is read out through the input port 305 (S102). If the switch 315 is in the "ON" state, it is recognized that the pack 20 is being installed, and also an electric power is supplied to the EEPROM 402 (S103). Then, various kinds of data stored in the EEPROM 402 are read out (S104). In EEPROM 402, various kinds of data including identification data (ID) of the types of ink and printing medium, parameters for printing control, and so on are previously stored at the factory. The read data from the EEPROM 402 is transferred to the host device 300 through the transmitter-receiver 304 such as Centronics parallel interface originally developed by the printer manufacturer Centronics (S105). Then, a printer driver of the host device 300 automatically generates an appropriate printing data based on that information without the selection of user and transmits the printing data to the ink-jet printer. That is, the host device 300 automatically generates an appropriate printing data and transmits the printing data to the ink-jet printer in consideration of image-processing, the amount of ink to be ejected, the number of print passes (the number of passes in the multiple passes), and so on which are appropriate to the combination of the printing medium and the ink in the pack 20 to be installed in the ink-jet printer. In the step S105, the MPU 301 sets parameters for the control of printing to the control register in the inside of the printer based on the read data from the EEPROM 402. Then, the electric power supply to the EEPROM 402 is suspended (S107), and the hardware is switched into a standby state (S109).

The switch 315 for detecting the pack placement is in the "OFF" state, the MPU 301 sets the parameters for the control of printing on ordinary paper to the control register in the inside of the printer (S108). Hence, the ink-jet printer is set to complete the setup for printing the printing data with a print quality and a printing speed instructed by the user trough the printer driver of the host device 300, followed by entering the standby state (S109).

During the standby state (S109), the ink-jet printer waits to receive the printing data from the host device 300. If the printing data is not received, the state of the switch 315 for detecting the pack placement is periodically monitored (S111). If a change in the state of the switch 315 is detected, then the state of the pack 20 is judged (S112).

If it is judged that the pack 20 is changed to the unloaded state from the loaded state, the MPU 301 sets the parameters for controlling the printing on ordinary paper to the control register in the inside of the printer (S113). Hence, the ink-jet printer is set to complete the setup for printing the printing data with a print quality and a printing speed instructed by the user trough the printer driver of the host device 300, followed by entering the standby state (S109).

Conversely, if it is judged that the pack 20 is changed to the loaded state from the unloaded state, the MPU 301 reads out various kinds of data from the EEPROM 402 in the pack 20 (S115). The data includes identification data (ID) of the types of ink and printing medium, parameters for printing control, and so on which are previously stored in the EEPROM 402 at the factory. The read data from the EEPROM 402 is transferred to the host device 300 through the transmitter-receiver 304 such as Centronics parallel interface (S116). Then, a printer driver of the host device 300 automatically generates the appropriate printing data based on that information without the selection of user and transmits the printing data to the ink-jet printer. That is, the host device 300 automatically generates the appropriate printing data and transmits the printing data to the ink-jet printer in consideration of image-processing, the amount of ink to be ejected, the number of print passes (the number of passes in the multiple passes), and so on which are appropriate to the combination of the printing medium and the ink in the pack 20 to be installed in the ink-jet printer. In the step S116, the MPU 301 sets parameters for the control of printing to the control register in the inside of the printer based on the read data from the EEPROM 402 (S117). Then, the electric power supply to the EEPROM 402 is suspended (S118), and the hardware is switched into a standby state (S109).

During the standby state (S109), if the printing data is received, the MPU 301 reads out and compare the immediately preceding ink information and the next ink information to be used (S119). The immediately preceding ink information means the information regarding the type of ink stored in the sub tank on the carriage and provided as ink to be used by the printing head at the immediately preceding printing movement. In this embodiment, the immediately preceding ink information is for each of four sub tanks corresponding to four printing heads, respectively. In addition, the next ink information to be used means that the information regarding the type of ink which must be stored in the sub tank on the carriage and provided as ink to be used by the printing head at the next printing movement. In this embodiment, the next ink information is for each of four sub tanks corresponding to four printing heads, respectively.

Regarding all sub tanks, if the information provided for the comparison is coincident with each other, that is, the ink used at the time of the immediately receding printing movement and the ink used at the time of the next printing movement are totally coincident with each other, there is no need to replace the ink as described later. Then, the printing movement is started just as it is (S121). Regarding at least one sub tank, on the other hand, if the information for the comparison is not coincident with each other, that is, the ink used at the time of the immediately receding printing movement and at least one ink used at the time of the next printing movement are not coincident with each other, the sub tank with mismatch ink is only subjected to the ink replacement operation as described later (S120) to replace the ink in the sub tank with ink to be used in the next printing movement. Then, the printing movement is performed after completing the replacement of ink (S120).

Accordingly, the sub tank that requires the replacement of ink is only subjected to the ink replacement in accordance with ink information read out of the EEPROM 402 of the pack 20 when the pack 20 is replaced with the new one before use. Thus, the useless consumption of the ink can be prevented, in comparison with the case that an ink replacement is done toward all the sub tanks at the time of replacing the pack 20 with the new one. In addition, the replacement of the pack 20 with the new one may be repeated several times without performing the replacement of ink. The replacement of ink may be only performed on the sub tank that requires the replacement of ink by appropriately recognizing such a sub tank just before the printing movement. As a result, the useless consumption of the ink can be prevented. In addition, the ink replacement is only performed on the sub tank that requires the ink replacement, so that eventually the time to be required for the ink replacement is shortened and the printing time is totally shortened.

Subsequently, after one page of printing movement has completed, the remaining number of the printing media in the pack 20 and the remaining amount of ink are calculated and then the obtained data are transmitted to the EEPROM 402 of the pack 20 to update these data (S122). In other words, areas for storing these data are acquired in the EEPROM 402, so that the number of printing media remained in the pack 20 and the remaining amount of ink are updated every time one page of printing movement is completed. The remaining number of the printing media remained in the pack 20 may be obtained by subtracting one from the remaining number of the printing media stored as date in the EEPROM 402 every time the ink-jet printer completes one page of printing movement. In addition, the remaining amount of ink in the pack 20 is obtained by subtracting the supplying amount of ink from the remaining amount of ink stored as date in the EEPROM 402 every time the action of supplying ink from the pack 20 to the sub tank is performed as described later. Therefore, the timing of updating the data for the remaining amount of ink stored in the EEPROM 402 may correspond to the timing of providing the supply of ink. The EEPROM 402 updates the data for the remaining amount of ink for every type of ink. In addition, the remaining number of the printing media and the remaining amount of ink are previously stored as in their respective full loaded conditions in the EEPROM 402 at the time of shipping the pack 20 filled with ink and the printing media.

Subsequently, the EEPROM 402 is switched off after performing the printing movement on a predetermined sheets of the printing media (S123), returning to the standby state (S109).

Consequently, the control procedure described above allows the printing movement of the ink-jet printer, without the instruction of the user, using data optimized for a combination of ink and printing media held in the ink media pack, so that a high quality image can be printed on the printing medium. In the steps S104 and S115, the following printing parameters for the ink-jet printing printer stored in the ROM 302 are also programmed on the basis of the data for types of printing media and ink read out by the MPU 301. That is, the printing parameters include a driving pulse width of the printing head, the number of dots formed by a preliminary ejection of ink for preventing the printing head from ink-ejection failure (the number of preliminary ejecting dots), time intervals of the preliminary ejection, a time intervals of recovering and sucking operations to keep the ejection condition of the printing head properly, and so on. In this case, the control procedure may be further optimized with the optimization of the printer driver.

In the strict sense, by the way, the remaining amount of ink in the ink-storage portion is calculated on the basis of the amount of ink supplied to the sub tank in the carriage from the ink-storage portion. If the sub tank has a small space for holding ink and the ink-storage portion supplies ink to the sub tank at comparatively frequent intervals, the amount of ink ejected at the printing movement, ejected at the preliminary ejection, or the like may be directly used for the calculation of the remaining amount of ink in the ink-storage portion. In this case, for example, the remaining amount of ink for every color is read out from the EEPROM 402 when one page of printing is completed. Then, the amount of ink ejected at the preliminary ejection and the amount of ink ejected for one page of printing are subtracted from the remaining amount of ink for every color. If the sucking operation is performed, the amount of ink sucked is also subtracted from that amount. The result is written as the remaining amount of ink to the EEPROM 402.

By obtaining the data for the current number of printing media in the ink media pack, it is possible to send the data to the host device 300 and represent it on CRT of the host device 300. Therefore, the effect of improving a user interface is improved. Furthermore, the latest condition in the ink media pack can be always known, so that the information concerned about such a condition can be used in the process for determining the replenishing amount of ink at the recycling, or the like.

In this embodiment, by the way, identification data (ID) concerned about the types of ink and printing medium stored in the ink media pack are read out and then parameters for printing control stored in the ROM 302 are read out and set on the basis of the above ID. According to the present invention, however, the above parameters may be previously stored in the EEPROM 402 of the ink media pack and then directly read out of the EEPROM 402 to set them in a print control circuit of the ink-jet printer. This process allows the control of printing optimized for a combination of printing media and ink even if such a combination thereof is newly designed and installed in the pack after shipment or sale of the ink-jet printer and additionally provided to the user.

In the following description, the replacement of ink will be explained in detail.

If a print command is generated, at first, then the carriage moves to a recovery system where ink is sucked from the printing head to empty both the printing head and the sub tank on the carriage. Subsequently, the carriage moves to a position for the ink supply from the ink media pack or a position for the ink supply in the ink-jet printer to provide a supply of ink for every ink color. Accordingly, the replacement of ink is performed on the sub tank by supplying ink after emptying the sub tank. As described above, such an ink replacement is only performed on the sub tank that requires the replacement of ink. After completing the ink replacement, a sheet of the printing medium is fed from the ink media pack and then subjected to the printing movement. After completing the printing movement, the printing medium is discharged from the printer. If the ink supplying is required for the only printing head, as described above, the carriage moves to a position for the ink supply from the ink media pack or a position for the ink supply in the ink-jet printer to provide the printing head with a supply of ink for every ink color.

[Other Embodiments]

In each of the embodiments described above, the ink-jet printer is designed that the pack integrally comprising an combination of ink and printing media is mounted on the printer in a replaceable manner and ink is supplied to the sub tank from the ink tank in the pack. According to the present invention, however, an ink tank which is not comprised in the integral-type pack may be mounted on the printer in a replaceable manner to supply ink from such an ink tank to the sub tank. In either case, ink is only supplied to a sub tank that requires an ink replacement in an ink-jet printing apparatus that performs a printing movement by supplying ink from a plurality of ink tanks that store various inks (or a pack integrally comprising a combination of printing media and ink) to a plurality of sub tanks.

Furthermore, the printing head capable of ejecting ink may be an ink-jet printing head that comprises electrothermal converters that generate thermal energies to be used as ink-ejecting energies. That is, bubble is formed by the application of thermal energies and the pressure generated by the formation of the bubble is used for the ejection of an ink droplet through the ejection port. In each of the above embodiments, the serial type printing apparatus is described. According to the present invention, however, a full-line type printing head that performs a printing movement using a printing apparatus with its long length extending in the direction along a width of the printing medium may be applied.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink-transport system for transporting ink to a printing head capable of ejecting ink, said printing head including an ink ejecting portion for ejecting ink, a sub tank portion made of a flexible material that stores ink and communicates with the ink ejecting portion, a first open/close mechanism for allowing a communication between the inside of the sub tank portion and its outside through a passage, and a second open/close mechanism for allowing a communication between a space portion housing the sub tank portion and its outside, said ink transport system comprising:

a first selector means for selecting one state for the inside of the sub tank portion, from a state in which the inside of the sub tank portion opens to atmosphere and a state in which the inside of the sub tank portion communicates with an ink storage container that stores ink to be supplied to the printing head; and a second selector means for selecting one state for the printing head, from a state in which pressure in the printing head can be reduced and a state in which the printing head communicates to the atmosphere;

wherein the passage communicates the inside of the sub tank through the first open/close mechanism, and the first selector means is removably connected to the first open/close mechanism to select the one state for the inside of the sub tank.

2. An ink-transport system for transporting ink to a printing head capable of ejecting ink, said print head including an ink ejecting portion for ejecting ink, a sub tank portion made of a flexible material that stores ink and communicates with the ink ejecting portion, a first open/close mechanism for allowing a communication between the inside of the sub tank portion and the its outside through a passage, and a second open/close mechanism for allowing a communication between a space portion housing the sub tank portion and its outside, said ink transport system comprising:

a first selector means for selecting one state for the passage, from a state in which the passage opens to atmosphere and a state in which the passage communicates with an ink storage container that stores ink to be supplied to the printing head; and a second selector means for selecting one state for the printing head, from a state in which pressure in the printing bead can be reduced and a state in which the printing head communicates to the atmosphere;

wherein the second selector means comprises: a first communication portion which is removably connected to the second open/close mechanism and which communicates with the space portion through the second open/close mechanism; and a second communication portion which communicates with the ink ejecting portion, where a third open/close mechanism is provided on a communication passage of the second communication portion.

3. An ink-transport system as claimed in claim 1 or claim 2, further comprising a removable passage between the printing head and the ink storage container.

4. An ink-transport system as claimed in claim 1 or claim 2, wherein the second selector means is connected to a negative pressure source.

5. An ink-transport system as claimed in claim 1 or claim 2, wherein the printing head produces a bubble in ink by a thermal energy and ejects ink by an energy generated by the bubble.

6. An ink-transport system for transporting ink to a printing head capable of ejecting ink, wherein the printing head comprises:

an ink ejecting portion for ejecting ink;

a sub tank portion made of a flexible material that stores ink and communicates with the ink ejecting portion;

a first open/close mechanism for allowing a communication between the inside of the sub tank portion and its outside; and a second open/close mechanism for allowing a communication between a space portion housing the sub tank portion and its outside, and wherein said ink-transport system comprises:

an atmospheric pressure introducing means which introduces atmospheric pressure into the inside of the sub tank portion;

an ink supply means which supplies ink from an ink supplying source to the inside of the sub tank portion;

an ink draining means which drains ink from the inside of the sub tank portion through the ink ejecting portion; and a pressure regulating means which regulates a reduced pressure in the space portion.

7. An ink-transport system as claimed in claim 6, wherein the atmospheric pressure introducing means and the ink supply means are communicated with the sub tank portion through a common passage, and further comprising:

a first selector means provided on die common passage to select one state for the sub tank portion, from a state in which the sub tank portion communicates with atmosphere through the atmospheric pressure introducing means and a state in which the sub tank portion communicates with the ink supply source through the ink supply means.

8. An ink-transport system as claimed in claim 7, wherein at least a portion of the common passage is removable.

9. An ink-transport system as claimed in claim 7, further comprising a first open/close valve mechanism provided on the common passage.

10. An ink-transport system as claimed in claim 6, wherein the pressure regulating means comprises:

a passage provided in the printing head to communicate with the space portion, wherein a source of negative pressure is removably connectable to the passage; and a second open/close valve mechanism provided on the passage.

11. An ink-transport system as claimed in claim 10, wherein the second valve mechanism is closed when the space portion is in a state or reduced pressure and opened when a pressure in the space portion is regulated.

12. An ink-transport system as claimed in claim 10, wherein the ink draining means communicates with the source of negative pressure and is removably connectable to the ink ejecting portion in a removable manner.

13. An ink-transport system as claimed in claim 6, wherein the ink supply means supplies ink to the sub tank portion after an air introducing process by the atmospheric pressure introducing means and an ink draining process by the ink draining means are repeated a predetermined number of times.

14. An ink-transport system as claimed in claim 6, wherein the ink supplying source comprises an ink tank fixed on an ink-jet printing apparatus.

15. An ink-transport system as claimed in claim 6, further comprising:

an ink media pack integrally comprising a combination of a printing medium storage portion for storing printing media and an ink storage portion for storing ink, wherein the ink supplying source is comprised of the ink storage portion.

16. An ink-transport system as claimed in claim 6, further comprising:

an ink tank fixed on an ink-jet printing apparatus; and an ink media pack integrally comprising a combination of a printing medium storage portion for storing printing media and an ink storage portion for storing ink, wherein the ink tank or the ink storage portion is selectively used as the ink supplying source.

17. An ink-transport system as claimed in claim 6, wherein the printing bead produces a bubble in ink by a thermal energy and ejects ink by an energy generated by the bubble.

18. An ink-jet printing apparatus comprising an ink-transport system as claimed in claim 1, claim 2, or claim 6.

19. A method for replacing ink to be ejected from a printing head, in an ink-jet printing apparatus that performs a printing operation by discharging ink stored in an ink reserving portion through the printing head, comprising the steps of:

introducing air into the ink reserving portion;

draining ink and air from the ink reserving portion to its outside;

introducing ink into the ink reserving portion from which ink and air were drained at the draining step; and generating a reduced pressure for keeping the inside of the ink reserving portion, into which ink is being introduced by the ink introducing step, under reduced pressure enough to stabilize a meniscus of ink formed in the printing head;

wherein the ink reserving portion comprises an ink introducing opening for introducing ink into the inside of the ink reserving portion and an air introducing opening for introducing air into the inside of the ink reserving portion, wherein the ink introducing step includes an ink introduction switching step of switching between a state in which the ink introducing opening and an ink supplying source are communicated with each other and a state in which the ink introducing opening and the ink supplying source are closed from each other;

wherein the air introducing step includes an air introduction switching step of switching between a state in which the air introducing opening and an air supplying source are communicated with each other and a state in which the air introducing opening and the air supplying source are closed from each other;

wherein the reduced pressure generating step includes a step of keeping the inside of the ink reserving portion from which ink and air were drained at the draining step at a reduced pressure, wherein the ink introducing opening communicates with the ink supplying source by the ink introduction switching step so that ink is introduced into the ink reserving portion which is in the state of reduced pressure by the reduced pressure generating step, and wherein the air introducing opening communicates with the air supplying source by the air introduction switching step so that air is introduced into the ink storage portion which is in the state of reduced pressure by the reduced pressure generating step.

20. A method for replacing ink as claimed in claim 19, wherein ink is supplied into the ink reserving portion by the ink introducing step after the air introducing step and the ink introducing step are repeated a predetermined number of times.

21. A method for replacing ink as claimed in claim 19, wherein an ink tank fixed on an ink-jet printing apparatus is provided as the ink supplying source.

22. A method for replacing ink as claimed in claim 19, further comprising:

an ink media pack integrally comprising a combination of a printing medium storage portion for storing printing media and an ink storage portion for storing ink, wherein the ink storing portion is used as the ink supplying source.

23. A method for replacing ink as claimed in claim 19, further comprising: an ink tank fixed on an ink-jet printing apparatus; and an ink media pack integrally comprising a combination of a printing medium storage portion for storing printing media and an ink storage portion for storing ink, wherein the ink tank or the ink storage portion is selectively used as the ink supplying source.

24. An ink-jet printing apparatus comprising means for executing each step in an ink replacement method as claimed in claim 19.

* * * * *

UNITED STATES PATENT AND TRADEMARK OFFICE

CERTIFICATE OF CORRECTION

PATENT NO. : 6,536,885 B2
DATED : March 25, 2003
INVENTOR(S) : Akira Kuribayashi et al.

It is certified that error appears in the above-identified patent and that said Letters Patent is hereby corrected as shown below:

Column 1,
Line 43, “an printing” should read -- a printing --; and
Line 46, “are integrally are” should read -- are integrally and --.

Column 6,
Line 5, “s” should read -- a --.

Column 8,
Line 13, “an” should be deleted.

Column 9,
Line 23, “the” should read -- of the --; and
Line 67, “an” should read -- a --.

Column 10,
Line 2, “an” should read -- a --.

Column 13,
Line 31, “wards” should read -- words --.

Column 19,
Line 9, “of f” should read -- off --.

Column 22,
Line 53, “an” should read -- a --.

Column 26,
Line 3, “an” should read -- a --;
Line 30, “a urging” should read -- an urging --; and
Line 57, “an” should read -- a --.

Column 30,
Line 61, “an” should read -- a --.

Column 36,
Line 63, “an” should read -- a --.

UNITED STATES PATENT AND TRADEMARK OFFICE

CERTIFICATE OF CORRECTION

PATENT NO. : 6,536,885 B2
DATED : March 25, 2003
INVENTOR(S) : Akira Kuribayashi et al.

It is certified that error appears in the above-identified patent and that said Letters Patent is hereby corrected as shown below:

Column 37,
Line 63, “the” should be deleted.

Column 38,
Line 8, “bead” should read -- head --.

Column 39,
Line 14, “or” should read -- of --; and
Line 52, “bead” should read -- head --.

Column 40,
Line 54, “storing” should read -- storage --.

Signed and Sealed this

Fourth Day of November, 2003

JAMES E. ROGAN
*Director of the United States Patent and Trademark Office*